US006192634B1

(12) United States Patent
Lopez

(10) Patent No.: US 6,192,634 B1
(45) Date of Patent: Feb. 27, 2001

(54) DUAL NETWORK DOME STRUCTURE

(75) Inventor: Alfonso E. Lopez, Irvine, CA (US)

(73) Assignee: Temcor, Carson, CA (US)

( * ) Notice: Subject to any disclaimer, the term of this patent is extended or adjusted under 35 U.S.C. 154(b) by 0 days.

(21) Appl. No.: 09/180,054

(22) PCT Filed: Sep. 17, 1997

(86) PCT No.: PCT/US97/21376

§ 371 Date: Oct. 29, 1998

§ 102(e) Date: Oct. 29, 1998

(87) PCT Pub. No.: WO98/12398

PCT Pub. Date: Mar. 26, 1998

Related U.S. Application Data

(60) Provisional application No. 60/025,761, filed on Sep. 20, 1996.

(51) Int. Cl.[7] ..... E04B 7/08

(52) U.S. Cl. ..... 52/81.2; 52/81.1; 52/639; 52/652.1; 52/653.1; 52/654.1

(58) Field of Search ..... 52/81.1, 81.2, 52/81.3, 653.2, 222, 639, 652.1, 653.1, 654.1

(56) References Cited

U.S. PATENT DOCUMENTS 2,908,236 * 10/1959 Kiewitt .
4,611,442 * 9/1986 Richter ..... 52/81
5,704,169 * 1/1998 Richter ..... 52/81.2

* cited by examiner

*Primary Examiner*—Carl D. Friedman
*Assistant Examiner*—Yvonne M. Horton
(74) *Attorney, Agent, or Firm*—Christie, Parker & Hale, LLP

(57) ABSTRACT

A reticulated dome structure (20) has an inner structural network (24) and an outer structural network (26). Each network has structural members (34, 38) connected at junctions (36, 40) to form various shapes of dome structures including: vault, vault with rounded ends, triangular, stadium, intersecting vault, and spherical. The junctions have two plates (54, 56) with the structural members fastened (68) therebetween to form moment bearing junctions. Tubular braces (32) are connected according to a desired plan between outer network junctions and inner network junctions to establish a desired substantially parallel spacing between the networks and to transfer loads locally between the networks. The network members subdivide outer and inner surfaces into polygonal areas which are of a uniform kind in the outer network. The outer network openings can be closed by closure panels (29, 170) which laterally stabilize the outer network members to which they are connected and structurally enhance that network.

27 Claims, 26 Drawing Sheets

24
48
46
44

DUAL NETWORK DOME STRUCTURE

This appln is a 371 of PCT/US97/21376 filed Sep. 17, 1997, and also claims the benefit of US Provisional No. 60/025,761 filed Sep. 20, 1996.

FIELD OF THE INVENTION

This invention concerns domes and dome-like structures of large span. More particularly, it pertains to structural systems which define such structures and in which upper and lower networks of structural members of high section modulus define respective surfaces which preferably are concentric, the networks being maintained in spaced relation by interconnecting braces which are of small section modulus and which transfer loads locally between the networks.

BACKGROUND OF THE INVENTION

Every year numerous multi-purpose sports arenas are built around the world. These stadia are often covered for weather protection, climate control, and acoustic control of the inside environment. The large maintenance costs of existing fabric and steel structures as well as the ever increasing construction costs of these stadia have created a need for the development of efficient structural systems that can reduce the weight of the overall cover, reduce the loads on the support structure or other foundation, shorten the construction time, integrate with roof or closure arrangements rather than merely support them, reduce the maintenance costs over the life of the structure, and reduce the construction cost of the structure.

Single network geodesic domes with up to 420 ft spans have been designed and constructed using extruded aluminum beams. Such a single network geodesic dome is described in the context of U.S. Pat. No. 3,909,994 to Richter which is incorporated herein by reference. The proven advantages of the use of aluminum in large span construction have enabled aluminum domes to compete successfully against steel, wood, and fabric domes. The advantages of aluminum construction include its light weight, corrosion resistance, ease of manufacturing, reduced maintenance, and high strength to weight ratio.

The basic contour of the surface of a dome, apart from local features of the surface, usually is a portion of a surface of revolution, such as a portion of a sphere, cylinder, ellipsoid, as examples. Other kinds of surface contours have been and can be used.

An approach to the structural design of a dome is to use a single network of structural members, or struts, which are located in and define the dome's basic contour surface and which are interconnected to subdivide that surface into a lattice of triangular, rectangular, pentagonal, hexagonal or other polygonal areas. The lattice area shape is exclusively or predominantly, in most instances, that of one kind of polygon. The construction of that structural network is simplest when all of the struts in the network are of uniform cross-section. From a buckling point of view, for typical live loads or snow loads the dome areas most susceptible to failure are its central areas. In the dome central region, loads are applied normal to the struts and cause those struts to buckle more readily than at the perimeter of the dome where the struts are more vertically oriented and form an acute angle relative to the applied loads.

If struts of depth and cross-sectional area adequate to carry central region loads are used throughout the dome, substantial portions of the dome will be over-designed. The dome will be heavier and more costly than truly required. If the use of stronger/deeper structural members is confined to the portions of the dome which are most susceptible to failure, complicated and expensive junction/hub connections are required at those places in the dome where structural members of different depths interconnect. This is especially true for large domes with concentrated loads at the center, such as sports arenas.

Theoretically, single network aluminum domes of this known kind can be used to span large distances, but as spans increase, so do the necessary size and commensurate cost of the struts which preferably are made by extrusion processes. Also, the large-section extrusions are produced in a limited number of places, leading to long lead times for order, delivery delays, and further increases in cost. Further, the size of structural shapes produced by the extrusion manufacturing process is limited. Specifically, aluminum extrusions can only be manufactured in depths up to 14 inches. In addition, aluminum has a low modulus of elasticity. These factors limit to approximately 450 ft. the span which single network aluminum dome structures built with struts of uniform sections can cover, and therefore, these circumstances effectively prevent domes of this kind from being used to enclose athletic stadia and the like where span distances on the order of 600 ft. or greater are required.

These considerations are magnified for sports arenas and other applications that require low profile or low rise covers (i e., shallow having low height). Thus, the maximum span of an aluminum single network low rise dome is smaller than 450 ft and buckling is a more serious problem. Single network low rise aluminum domes have been designed and built with spans up to 320 ft. in diameter, and these domes have approached the limits of the single network technology for low rise aluminum domes. To accentuate the problem, shallow domes are generally preferred over taller domes in most architectural applications, but because buckling is a more serious problem in shallow large diameter single network domes, single network aluminum extrusion domes are currently infeasible for many applications.

The most common mode of failure of single network low rise geodesic domes is called snap through buckling. In snap through buckling, the dome reverses curvature and cannot support applied loads over at least a portion of its area. Spherical domes and other curved structures are susceptible to snap through buckling. Unlike most structures, single network geodesic domes exhibit nonlinear geometric behavior. That is, as incremental load is applied, the incremental deflection of the structure becomes disproportionately larger. Snap through occurs when the structure is no longer capable of carrying load or the deflection of the structure becomes very large for a small incremental load. Such failure can occur when natural loads, such as wind, snow, or ice are added to design loads from lights, scoreboards, sound equipment, climate control equipment, cat walks, and other equipment suspended from the interior of the dome and the aggregate loads exceed the bucking capacity of the structure.

Construction of reticulated dome structures, i.e., domes in which the structural members are aligned along the lines of a network grid, can be performed using a large tower at a center opening in the structure; that opening may be closed later. An annular center portion of the structure is begun at (assembled around) the base of the tower and is attached to the top of the tower with hoist cables. When assembly of that initial top (central) portion of the dome is completed, it is raised upwardly by the hoist cables and the next portion (ring) of the structure is constructed at ground level as an outward extension of the annular central portion of the dome. This procedure is repeated until the structure is completed. This is a safe and efficient method for constructing a dome structure. However, when constructing a dome structure with a span of approximately 450 feet or greater, the height of the tower required to perform the erection becomes prohibitive, and this method of construction cannot be utilized.

Further, this method is impractical for structures with shapes other than spherical. Without the tower, the structures must be constructed by the attachment to the structure of one member at a time building slowly upward. This method can only be used for structures up to 250 ft in diameter and requires work in a dangerous environment high above ground level in mobile man-lifts to construct the entire structure. This approach also requires extensive shoring to prevent deformation of the structure during construction.

The foregoing circumstances demonstrate that a need exists for improved and efficient aluminum structural systems that can make use of aluminum extrusion technology to cover large sports arenas beyond approximately 450 ft. in span and which can utilize low profile designs for structures beyond approximately 400 ft. Further, benefit would be gained by using structural members which have a uniform cross sections. Further, there is a need for an efficient and safe method of constructing large aluminum reticulated dome structures and reticulated structures having non-spherical shapes. Thus, it is desirable to design and construct large span aluminum structural systems with aluminum members having the same depth throughout respective portions of the structure and to devise a safe method for constructing large structural systems with varying curvature.

BRIEF SUMMARY OF THE INVENTION

There is provided in the practice of this invention a novel structural system for domes and the like comprising an upper network and a lower network each formed in a respective curved surface by structural members of uniform sections connected at hubs or junctions. The surfaces defined by the two networks are segmented by the structural members into upper and lower network openings. A plurality of spacing braces serve only to transfer load between the two networks and to maintain spacing between the networks. The braces transfer loads between the networks substantially only locally. The sections (i.e., cross sections) of the members in the upper and lower network are large compared to the sections of the braces. In a preferred embodiment of the invention, a plurality of closure panels are attached to one of the networks (preferably the upper network) to form a closure system or roof which is integrated into the structural system, rather than merely being supported by it. The upper network is preferably fully triangulated between the nodes, but in an alternate embodiment the upper network is divided into rectangles. The shapes of the openings in the lower network can vary in size and shape. The lower network may include rectangles, hexagons, pentagons, triangles, or some combination thereof. Further, the lower surface may also be fully triangulated so that there is one triangle on the upper network for every triangle in the lower network. The triangles of the lower network can be enlarged (i.e. the triangulation frequency is reduced), so that there are, for example, four triangles in the upper network for every triangle on the lower network.

The upper network structural members or struts have substantially the same transverse cross section. The same is true of the lower network struts, and for greater convenience, the lower struts can have substantially the same transverse cross section as the upper struts. The braces provide the requisite, preferably uniform, spacing between the two networks. The braces have small cross sectional dimensions compared to the network struts because the braces only transfer relatively small loads locally between the two networks and because of the high bending stiffness of the two networks and the behavior of the system (when used for large span domes) which is characterized by equal axial loads for both networks. In many cases three braces extend from each junction of the lower network to different junctions of the upper network. In one embodiment, three braces extend from each junction of the upper network to different junctions of the lower network, and in another embodiment, two braces extend from each junction of the upper network to different junctions of the lower network. In still another embodiment, four braces extend from each lower junction to the upper junctions. These and other arrangements of the internetwork braces is a reflection of the different network lattice arrangements made possible by the high bending stiffness of each of the two networks.

Each junction in each network is comprised by an upper plate and a lower plate having the structural members (struts) fastened therebetween to form moment bearing junctions with high node rigidity in the independent and individual networks. Depending on the shapes of the openings defined by the network, the number of structural members attaching to a junction varies. In triangulated networks, the number can range from two (2) to six (6). Three structural members connect to a junction in a hexagonal network; six structural members connect to a junction in a filly triangulated network; in a large triangle configuration some junctions have sic structural members connected thereto and some junctions have two structural members connected thereto. In a rectangular configuration, there are four braces connected to each junction if the networks are out of phase, and four braces connected to every other junction in each network if the networks are in phase. Upper networks have these struts interconnected to form either only triangular network openings or only rectangular network openings. The lower network junctions in one kind of dome of this invention are preferably aligned with centers of the openings defined by the upper network struts.

Further, the structural systems having upper and lower networks can be used to design structures with varying curvature to form overall contours and configurations, including partial spherical, stadium, elliptical, oval, triangular, various types of vaults, and others. The vaults include forms such as a standard vault, a vault with rounded ends, and an intersecting vault.

This invention also provides a novel reticulated structure comprising a plurality of structural members connected at junctions to form a plurality of cone shaped sections. The cone sections are connected to form an ellipsoidal surface structure with an elliptical footprint. In a preferred embodiment for larger structures, the ellipsoidal structure has an internal network and an external network.

Further practice of this invention provides a novel method for constructing a dual network reticulated structure on a support surface. The method comprises constructing first outermost or perimeter subassemblies of the structure, positioning the outermost subassemblies into a desired attitude and position relative to the support surface, constructing a second set of subassemblies for either attachment to the first subassemblies or positioning relative to the support surface or both, positioning the second subassemblies, and successively repeating construction of further subassemblies and attaching the subassemblies where desired to complete the structure.

In a preferred embodiment of the invention, an outermost subassembly of approximately 100 ft by 60 ft is secured to the foundation, and connecting the structural members to the junctions comprises fastening an upper gusset plate to top flanges of a plurality of I-beam structural members and fastening a lower gusset plate to bottom flanges of the I-beam structural members, thereby forming a moment bearing junction. Further, constructing the outermost section comprises assembling a perimeter section, and the subassemblies are constructed so that they include external structural members and internal structural members with the spacing braces therebetween. Preferably, the subassemblies are constructed at ground level and raised into position relative to existing subassemblies for attachment thereto.

The dual network structural systems provided by this invention are materially different from those arrangements known as space frames. Space frames are defined by usually tubular members which usually are of the same diameter throughout the frame, the tubes all having the same manner of interconnection between them at nodes in the three-dimensional framework formed by the tubes. Space frames provide structural support for something else in most cases. When space frames are used in enclosed, i.e., roofed, structures, the roofing system is separate from and is merely supported by the space frame. In structural systems of this invention, on the other hand, the braces which extend between the load-carrying networks are of much lesser structural capacity than the network members, can and preferably do have cross sectional areas and geometries much different from the network members, and the requirements of their connections to the networks are modest compared to the requirement for the connections between the members in a network. Moreover, the present structural systems integrate and cooperate with roofing closure panels in a way which enhances the structural capacity of the dual networks.

These and other features and advantages of the present invention are more fully set forth in the following detailed description and the accompanying drawings in which similar reference characters denote similar elements throughout the several views.

TERMINOLOGY

Network—an arrangement or assembly of structural members interconnected in and defining a surface of desired contour or curvature.

Surface—a real or imaginary curved surface in which are located the several structural members of a network with their interconnections.

Grid—the lattice-like geometric arrangement of lines on the surface of the network to which the position of structural members correspond.

Strut—a structural member positioned along one of the grid line of a network.

Junctions (Hubs)—the physical structures which interconnect struts at defined places or points in a network. Junctions are located at nodes of reticulated surfaces.

Node—the idealized point in a grid representing the intersection of the grid lines.

Brace—a physical element which interconnects and defines the spacing between two networks and the surfaces defined by the networks.

Geodesic—a structural system is geodesic in that the principal load carrying features of the structure are arranged along geodesic lines, i.e., lines which pass over the shortest distance between two separated points on a surface; on a sphere, geodesic lines are arcs of great circles; the science of geodesics provides a way of subdividing a sphere so as to be triangulated by great circles.

Triangulate—to reticulate by interconnecting struts to divide the surface into the triangular shaped openings or openings having a shape defined by the omission of struts and/or junctions necessary to form triangular shaped openings;

Triangulation Frequency—the number of triangular shaped openings per unit area of surface adjusted by the number of gridlines on the source, by the number of nodes having corresponding junctions, and by the number of struts corresponding to gridlines.

Internal Network—the network in a dual network structural system which is toward the inside of the space bounded by the system; also called a lower network.

External Network—the network in a dual network structural system which is toward the outside of the building or the like in which the system is present; also called an upper network.

DETAILED DESCRIPTION

Figure 1:
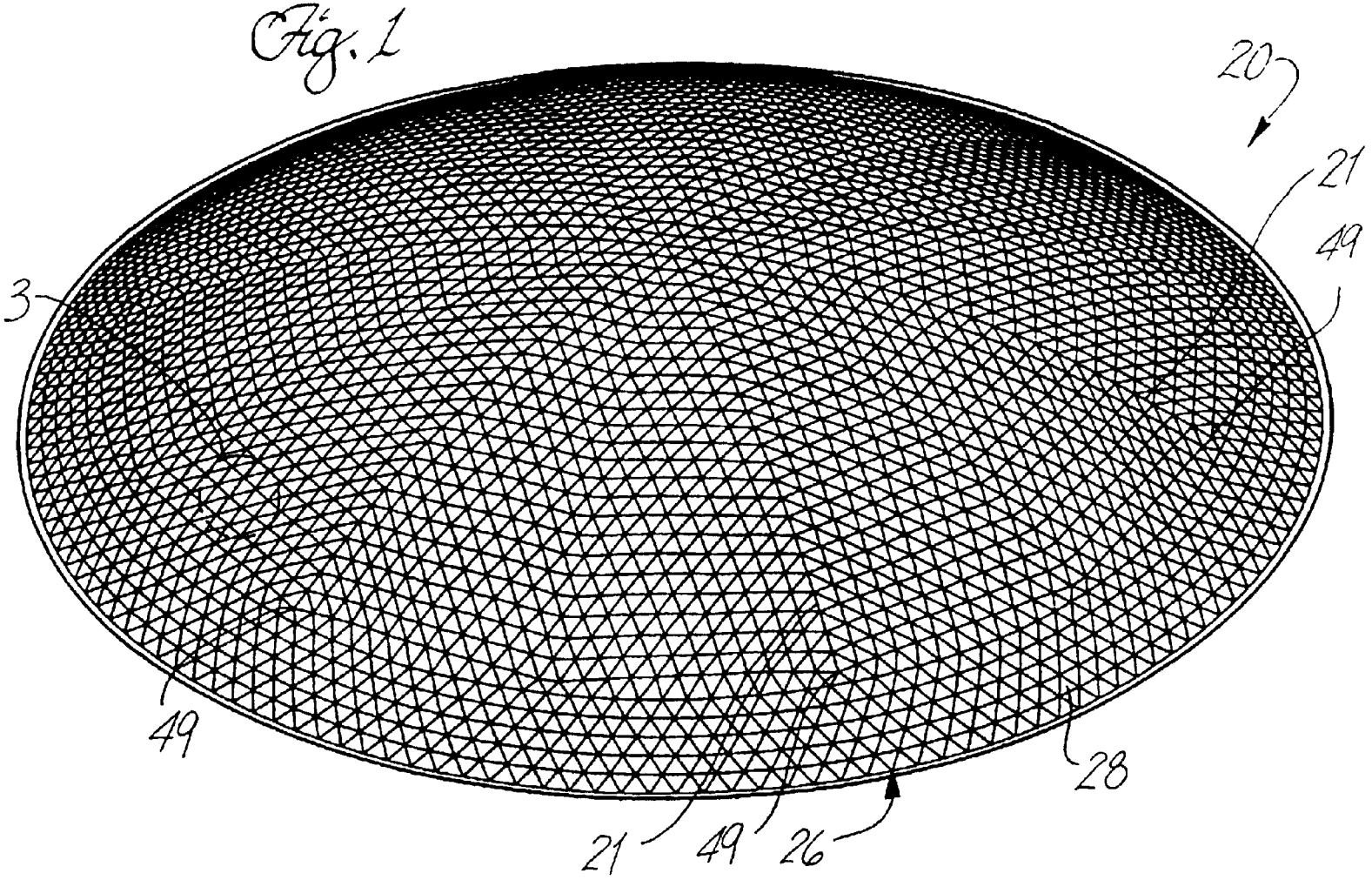
FIG. 1 is a perspective view of a spherical, triangular grid dual network structural system according to the present invention.

FIG. 1 shows an external (upper) network of a clear span, reticulated dual network dome structural system, generally designated 20, which is the shape of a partial spheroid. The dome is geodesic in that a plurality of the lines of the grid (which define the positions of struts discussed below) are great circles 21 of the sphere. The great circles define sectors therebetween. Other shapes and forms of reticulated structures will be discussed below. Some of the structures are geodesic in nature, others are not. Unless otherwise noted, the following discussion is generally applicable to all of the shapes of structural systems discussed below.

Figure 2:
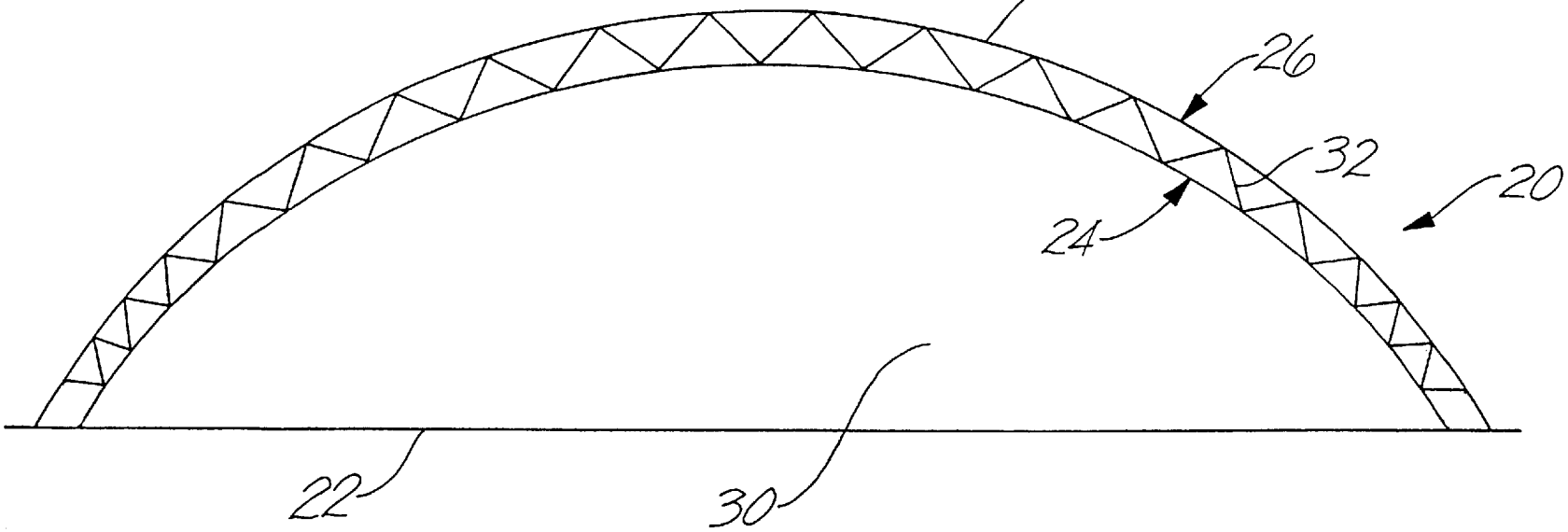
FIG. 2 is a schematic cross-sectional view of the structure of FIG. 1.

Referring to a cross section (FIG. 2) of the structure shown in FIG. 1, the dome is a reticulated structure resting on a support surface 22 or other foundation and having an internal (lower) network, generally designated 24, and an external (upper) network, generally designated 26. The separation between the networks, which is in the range of approximately 1 to 3 meters, is small when compared to the overall size of the structure. For some applications the support surface is movable. The external network is an outer layer that supports and integrates a closure system, roofing subsystem, or shell 28 made up of closure panels 29 (FIG. 3) in a manner which contributes to the structural behavior of the dual network system. The external and internal networks cooperate to define an internal cavity 30 which may have various openings to it through the networks depending on the application of the structure. Preferably, the closure panels are secured in place along the edges of each opening (see FIG. 26) to close the triangular openings defined in the network. The panels can be designed to provide a watertight skin which can be opaque, translucent, or transplant and can provide varying levels of sound insulation. The panel mounting arrangements described and shown in U.S. Pat. Nos. 3,477,752, 3,909,994, or 3,916,589 can be used if desired, and these references are hereby fully incorporated herein by reference. The internal network is spaced inwardly from and is connected to the outer network by spacing braces 32 (FIG. 2). The inner and outer networks are similarly shaped, so in this embodiment, each network is spherical and both networks lie in surfaces which preferably have the same center of curvature. Thus, the structure is a spherical dual network dome. Though it is preferred that the closure panels close the openings of the external network, the panels can also, or alternatively, close the internal network openings if desired.

Figure 3:
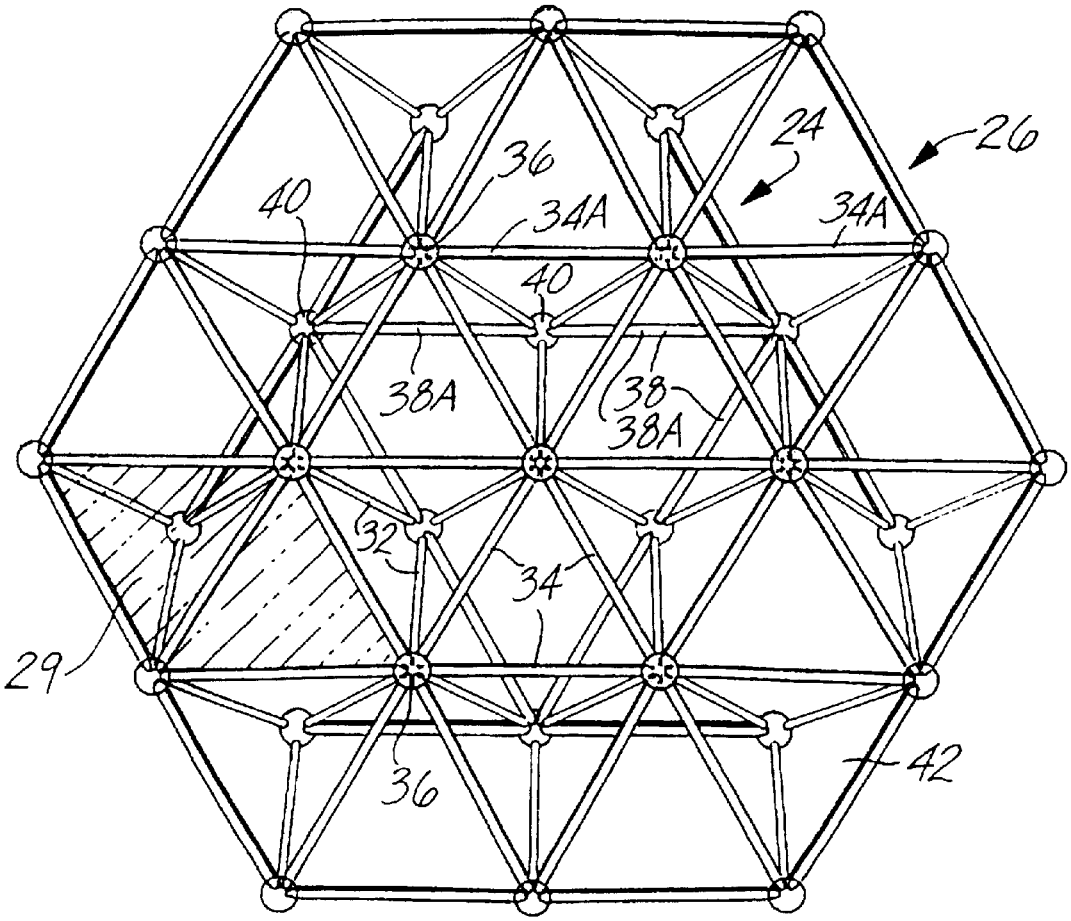
FIG. 3 is a top plan view of the dual network structure of FIG. 1 taken within area 3 illustrating a high frequency fully triangulated external network and a low frequency fully triangulated internal network.

Referring to FIG. 3, as previously indicated, the structural system is comprised of external and internal networks. The external network 26 comprises external structural members or struts 34 joined at external junctions 36. Similarly, the internal network 24 comprises internal structural members (struts) 38 joined at internal junctions 40. The struts are connected to form a plurality of network configurations which subdivide the surfaces defined by the networks into various polygonal openings 42. The shapes of the openings in the present embodiment are defined by triangulating the double curved surfaces that define the shape of the structure and by placing junctions at the nodes and struts on the lines of the network grids. In some of the embodiments to be discussed below, junctions are omitted at some nodes, and struts are omitted at some of the gridlines. However, the surface is still triangulated in that the openings could readily be made triangular in shape by placing a junction at every node and a strut at every grid line.

Figure 11:
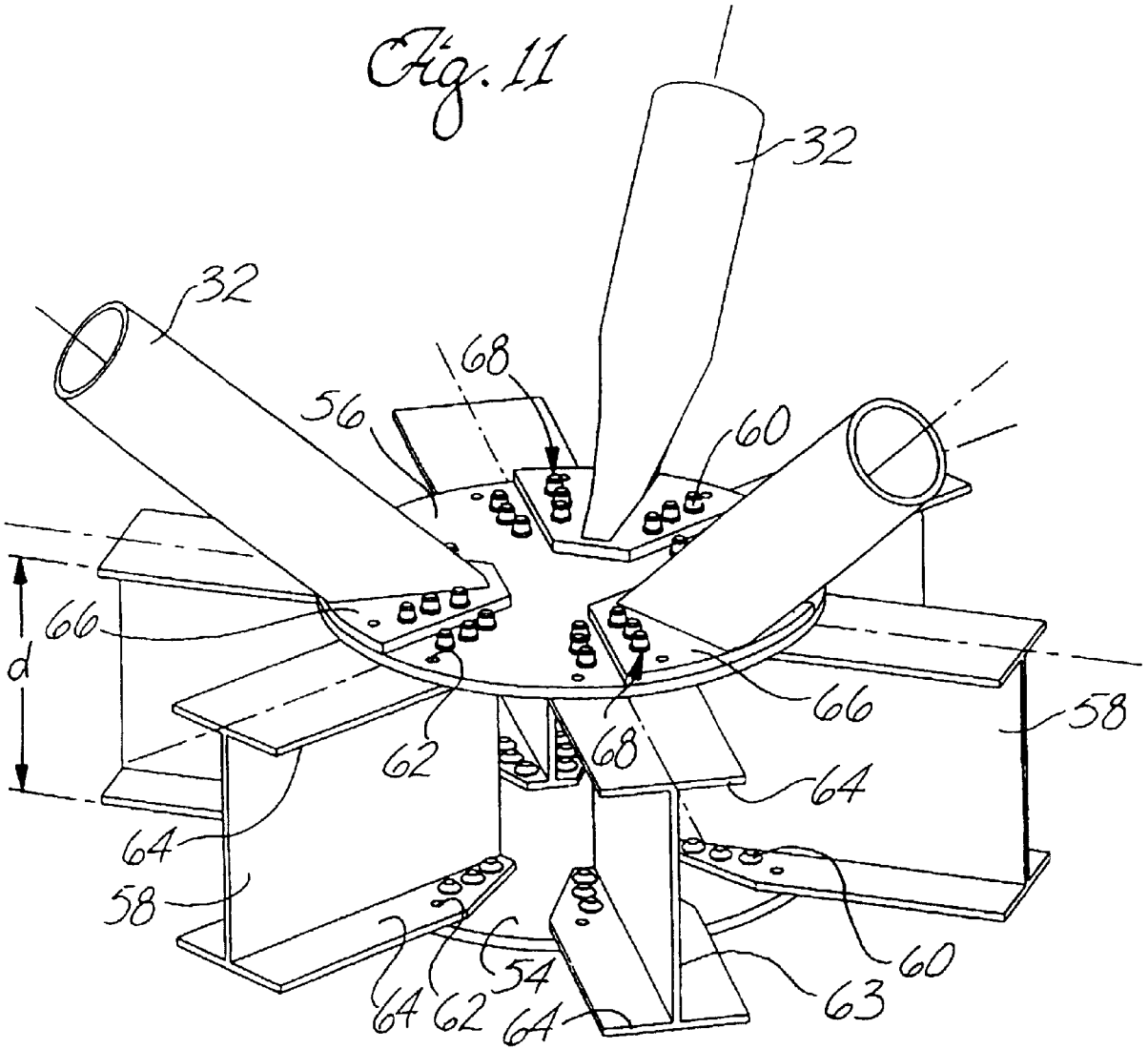
FIG. 11 is a perspective view of a junction of the dual network structural system of FIG. 1.

FIGS. 3, 7, 8, 23, and 27 depict the dual network dome in structurally simplified terms; they illustrate geometric aspects of and relationships between external and internal networks and the locations of braces between networks, of network struts, and of junctions between struts and braces. For ease of illustration in FIGS. 3, 7, 8, 23 and 27 the struts are shown in simplified form. The true natures of the struts and braces in dual network domes according to this invention are better and more correctly shown in FIGS. 11 and 26. FIG. 11, for example, shows that the network struts have depths and cross-sectional areas which are significantly greater than those of the braces, that the struts preferably are defined by aluminum extrusions having cross-sectional configurations of wide flange beams, and the braces preferably are defined by lengths of aluminum pipe or structural tubing. The struts in the upper and lower networks preferably have the same cross-sections except for those features of upper network struts shown in FIG. 26 which cooperate with closure panels to provide a load transferring and weather tight connection between those struts and those panels. It is within the scope of this invention, however, that the upper network struts can have a section modulus which is different from the section modulus of the lower network struts. It is the materially greater section modulus of the network struts (upper and lower)and high bending stiffness of the network connections, as compared to the braces, which affords the variability of network geometries and arrangements, and the range of overall dome shapes and forms, a factor which distinguishes the present large span dome structures from conventional space frames.

Figure 7:
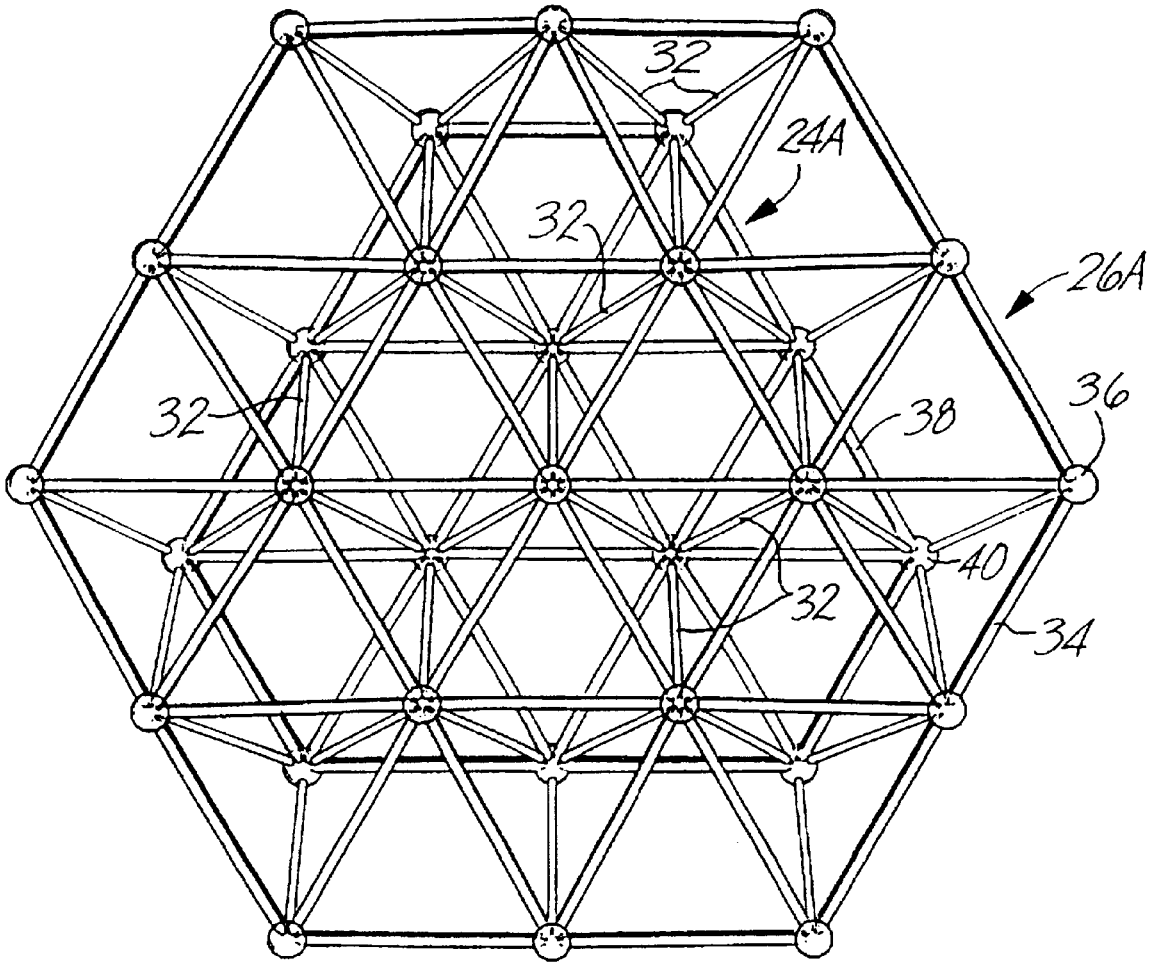
FIG. 7 is a plan view, similar to that of FIG. 3, of a second configuration for the networks illustrating a triangulated internal network.
Figure 8:
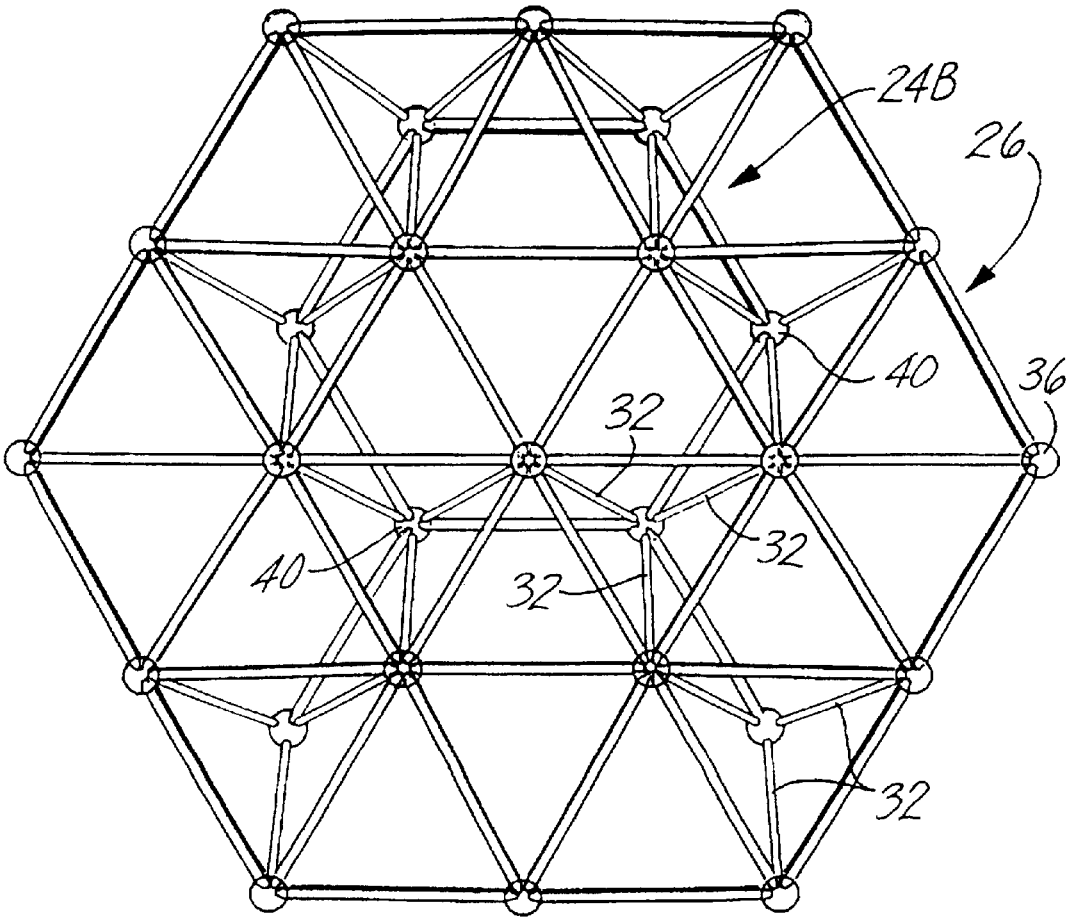
FIG. 8 is a plan view, similar to that of FIG. 3, of a third configuration for the networks illustrating an internal network with hexagonal shaped openings.

In the embodiment shown in FIG. 3, the internal and the external networks are out of phase. When the networks are out of phase, the nodes of the internal network are radially aligned below the centers of area of the triangles of the external network; compare FIG. 23 where the networks are in phase. Preferably, the location of the members of the inner network are defined by the external network. Once the triangulated exterior network is defined, for out of phase networks the nodes of the interior network are defined at the radial projections of the centers of the openings 42, and the inner nodes are connected in a triangular pattern as shown in FIGS. 3 and 7 or a hexagonal pattern as shown in FIG. 8. In an inner network with large triangles or full triangulation, FIGS. 3 and 7 respectively, the nodes are placed at every other opening. In other configurations, such as FIGS. 8, 23, and 27, different patterns can be used.

Figure 4:
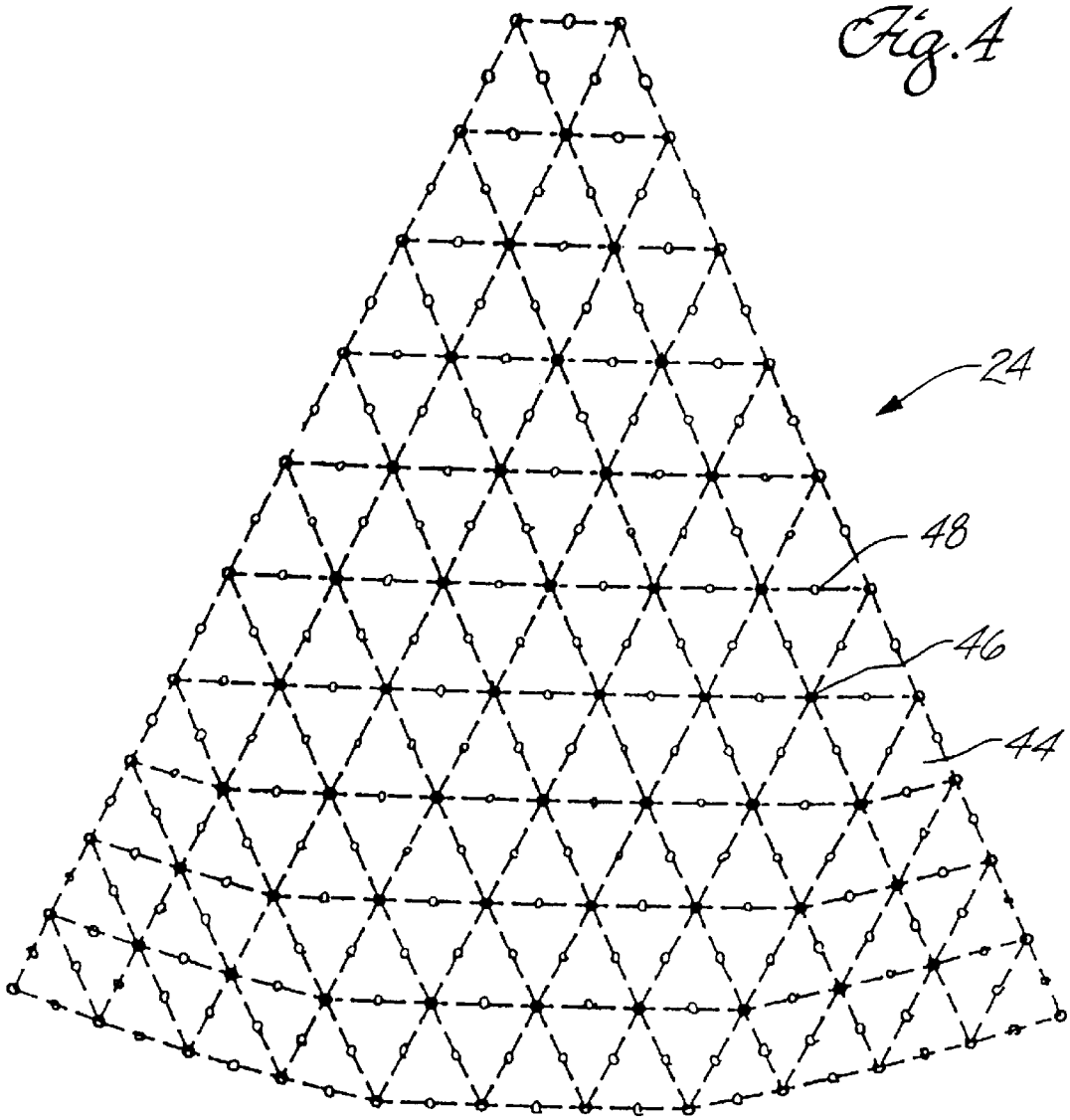
FIG. 4 is a schematic and fragmentary plan view of the triangulated configuration of the internal network of FIG. 3.
Figure 21:
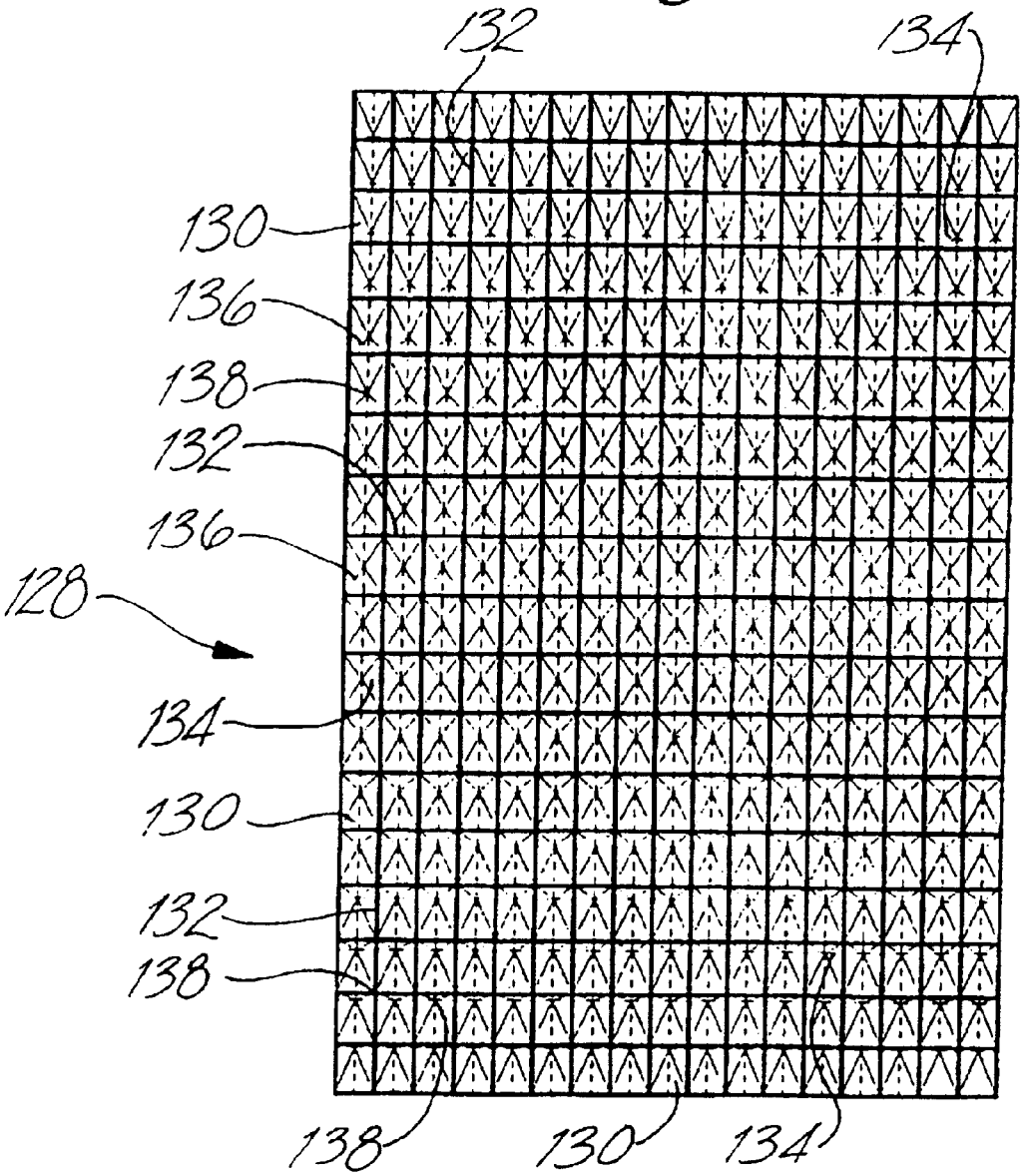
FIG. 21 is a schematic top view of a dual network reticulated structural system in which the external and internal networks subdivide their respective surfaces into rectangles.

The preferred configuration of the outer network is fully triangulated or, in the instance of the arrangement shown in FIG. 21, fully rectangulated. That is, with reference to FIG. 3 each typical junction of the external network 26 has six struts connected thereto, so that each junction cannot have another strut attached thereto. In this network configuration, all the geometric outer network openings 42 are triangles. In the configuration of the inner network, shown schematically in FIG. 4, the openings are large triangles 44. The internal junctions have different numbers of struts connected to them depending on their position in the network. Nodes at the vertices 46 of the triangles have corresponding junctions of six struts, and nodes at the midpoints 48 of the sides of the triangles have corresponding junctions of two struts. Thus, the internal network has a lower triangulation frequency than the external network. In this configuration there are four (4) triangles in the outer network for every triangle in the inner network. This configuration is obtained by triangulating the inner surface and omitting struts corresponding to a regular pattern on the grid so created.

As can be seen in FIG. 1, the networks predominantly consist of hexagons further divided into triangles by strut members. However, some dome designs can require occasional pentagonal shaped openings 49 or other shaped sections, which are preferably further triangulated, to complete the structure. The pentagonal shaped openings of FIG. 1 are located at adjoining corners of the bases of deltoid sectors defined between the great circle lines 21 of the spherical dome 20 shown in FIG. 1.

Figure 5:
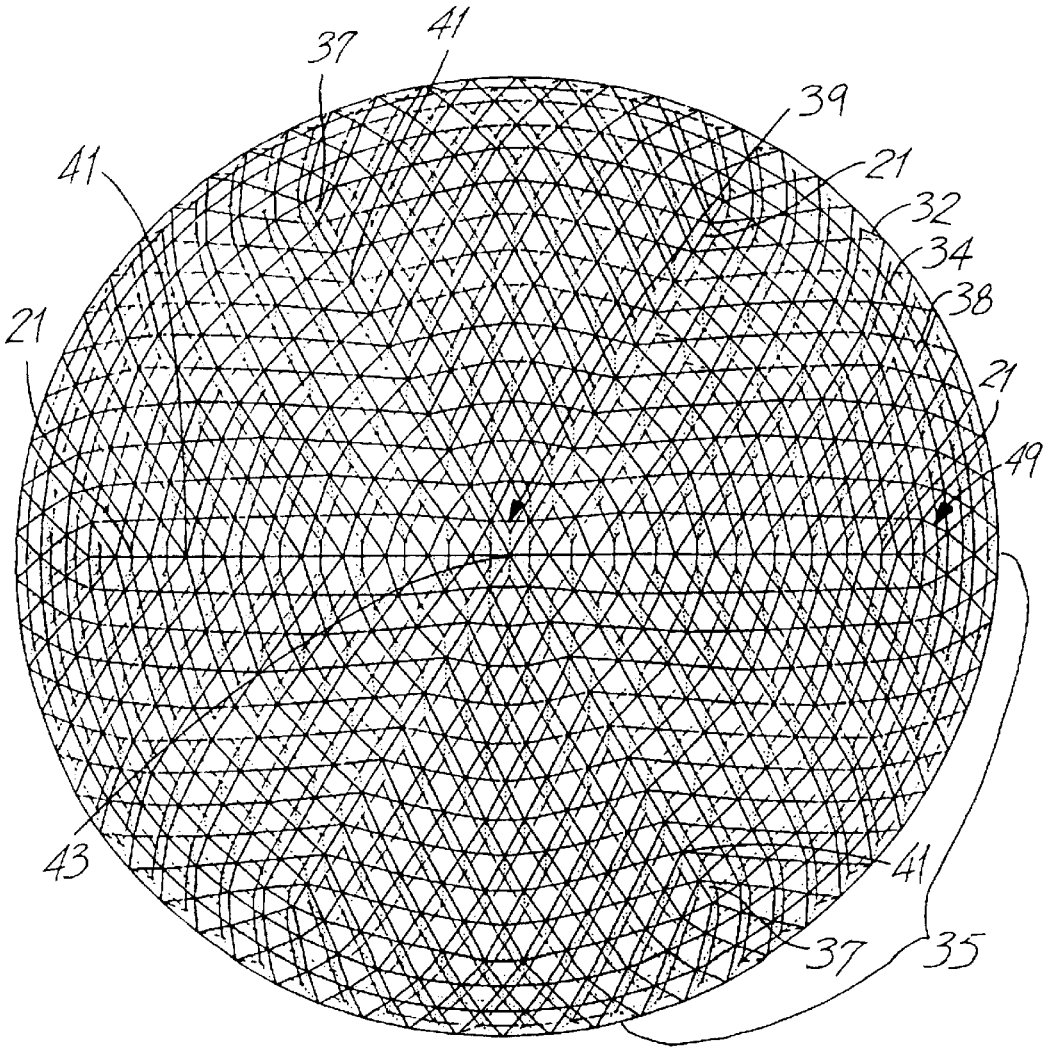
FIG. 5 is a top schematic plan view of the structure according to FIG. 1.
Figure 6:
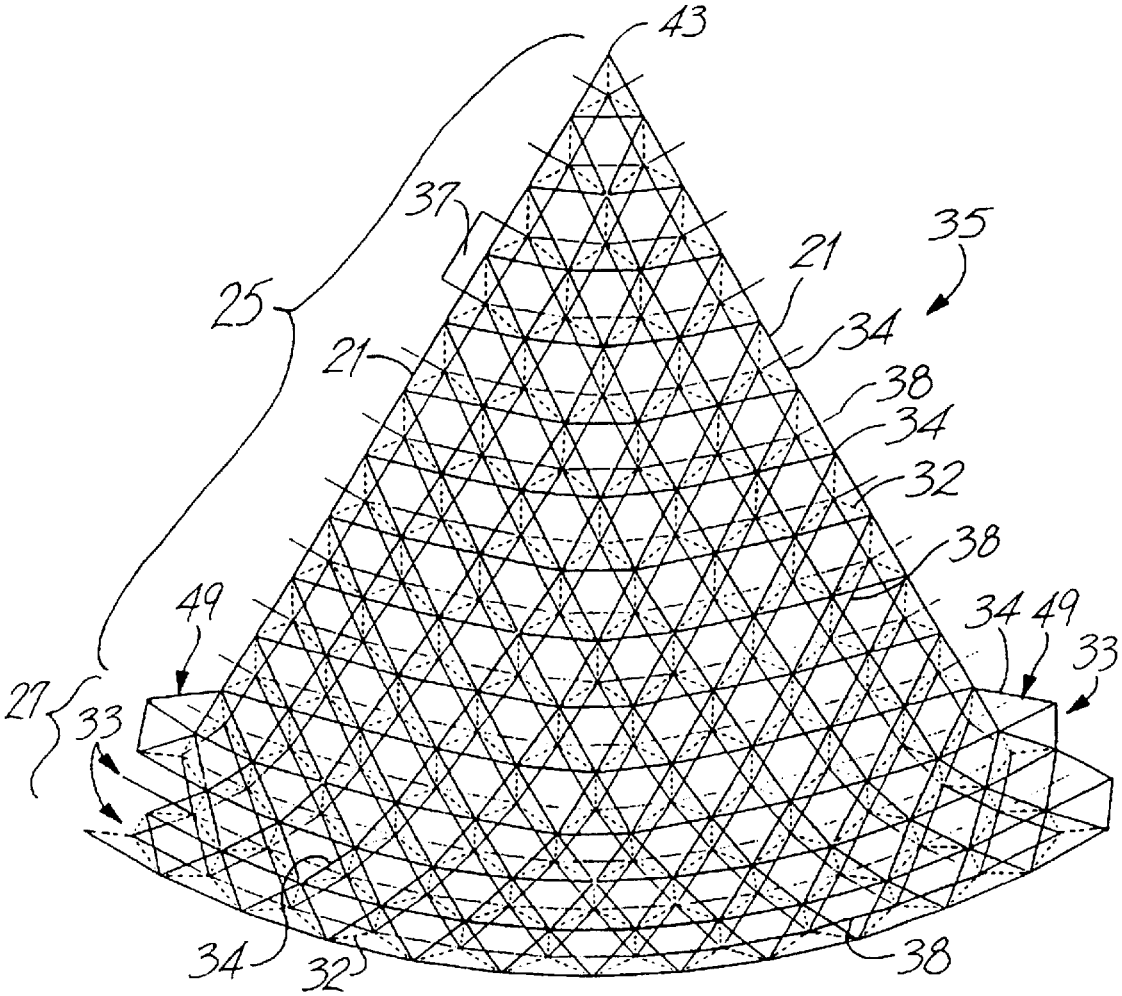
FIG. 6 is a fragmentary plan view of a sector of the view of FIG. 5 illustrating a transitional section between the upper and lower geometries of the structural system.

Referring additionally to FIGS. 5 and 6, the dome of FIG. 1 has an upper (central) geometry 25 and a lower (perimetral) geometry 27. The dark lines of FIGS. 5 and 6 are the external struts 34; the light lines are the internal struts 38, and the dashed lines represent the spacing braces 32. The upper geometry is comprised of the deltoid sectors 35 bound by the great circles 21 of the sphere. Thus, there are several transitional sections in the dome as well as in the other structures to be discussed below. The upper geometry, which is commonly called a Lamella geometry extends to the transition section where the pentagonal openings 49 are located. In the structural system 20 shown, the internal network has no pentagons.

The lower geometry of dome 20 comprises rings, generally designated 33 (see FIG. 6), of triangles forming an extension section which completes the dome. Preferably, the triangles in the extension section are deformed to make the rings more circular, and the inner network is fully triangulated in the extension section and in the transition section between the upper and lower geometries. In the transitional sections between sectors of symmetry of the upper geometry, the inner network includes a row of rectangles 37 which run up to a center hexagon, generally designated 39, at the top center of the dome. The external nodes 41 (see FIG. 6) corresponding to the inner rectangles 37 have four spacing braces connected thereto, and the external hexagons above the rectangles have a high degree of irregularity when compared to the other external hexagons. External central node 43 has six spacing braces extending therefrom to the nodes of a central internal hexagon, which is smaller in size than the other hexagons of the internal network and located directly below the external center node 43. With no pentagons in the internal network, the outermost internal rectangle along each sector of symmetry in each row with surrounding internal hexagons is connected to the nodes of the external pentagon 49 with the spacing braces. These unique transitional configurations make possible the use of the systems defined in this invention on a typical dome geodesic geometry.

Referring to FIG. 7, a different configuration of network struts utilizes a fully triangulated external network 26A and a fully triangulated internal network 24A. Thus, the internal and external triangulation frequencies are the same. Again, in the preferred embodiment shown, the nodes of the internal network are substantially radially aligned with the geometric centers of the openings of the external network; with the full triangulation of the internal network, the nodes of the external network are also radially aligned with the geometric centers of the triangles in the internal network. For non-spherical structures, the nodes of the internal network and the geometric centers of the triangles in the outer network are aligned along a radial line normal to the outer surface. For structures of this kind, as compared to the kind of structures shown in FIG. 23, the internal nodes are located by projecting lines from the area centers of the outer network openings. The lines projected from the geometric centers are normal to the planes defined by the structural members which connect to form the openings. When both the networks have the same triangulation frequency, there are the same number of triangles in each network. The equally triangulated internal network is preferable for some applications because, for example, there are more structural members in the FIG. 7 lower network configuration than the lower network configuration of FIG. 3, and therefore, the former can bear greater loads. Generally, the higher the number of struts there are in a network configuration, the greater the load it can support. Thus, the triangulation frequency is, in part, a function of the expected loading of the structure.

Figure 9:
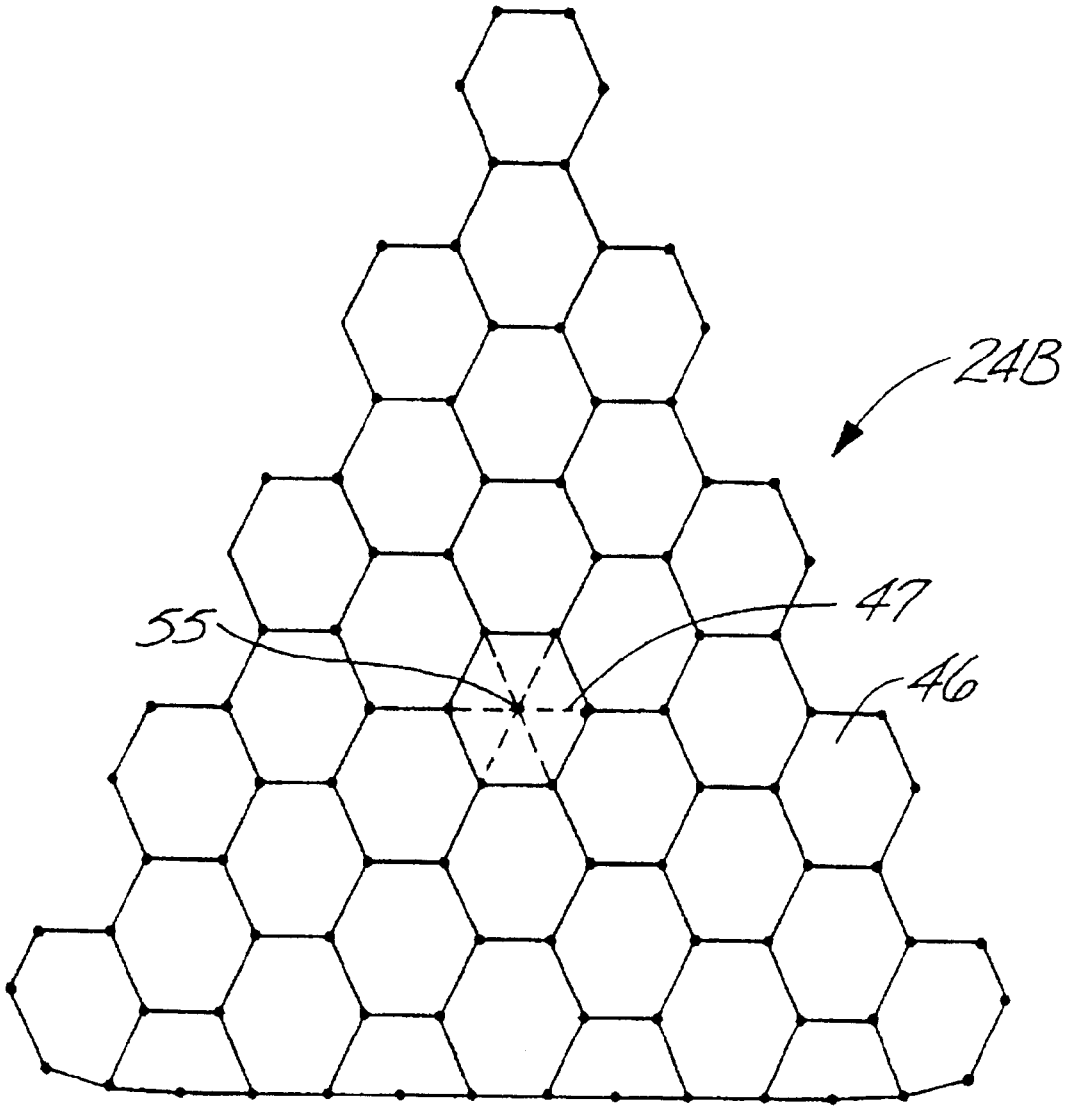
FIG. 9 is a schematic plan view of the internal network of FIG. 8 having hexagonal shaped openings.

Another internal configuration is shown in FIGS. 8 and 9. The internal network 24B is comprised of hexagonal openings 46. In the hexagonal internal network configuration, each junction has three struts connected thereto. Dashed lines 47 (FIG. 9) illustrate that the configuration is obtained by triangulating the surface and omitting junctions and struts in a regular pattern. The dashed lines represent omitted struts and node 55 represents an omitted junction. Thus, the regular pattern of omitted struts and junctions forms the hexagonal opening; of this network configuration.

Figure 10:
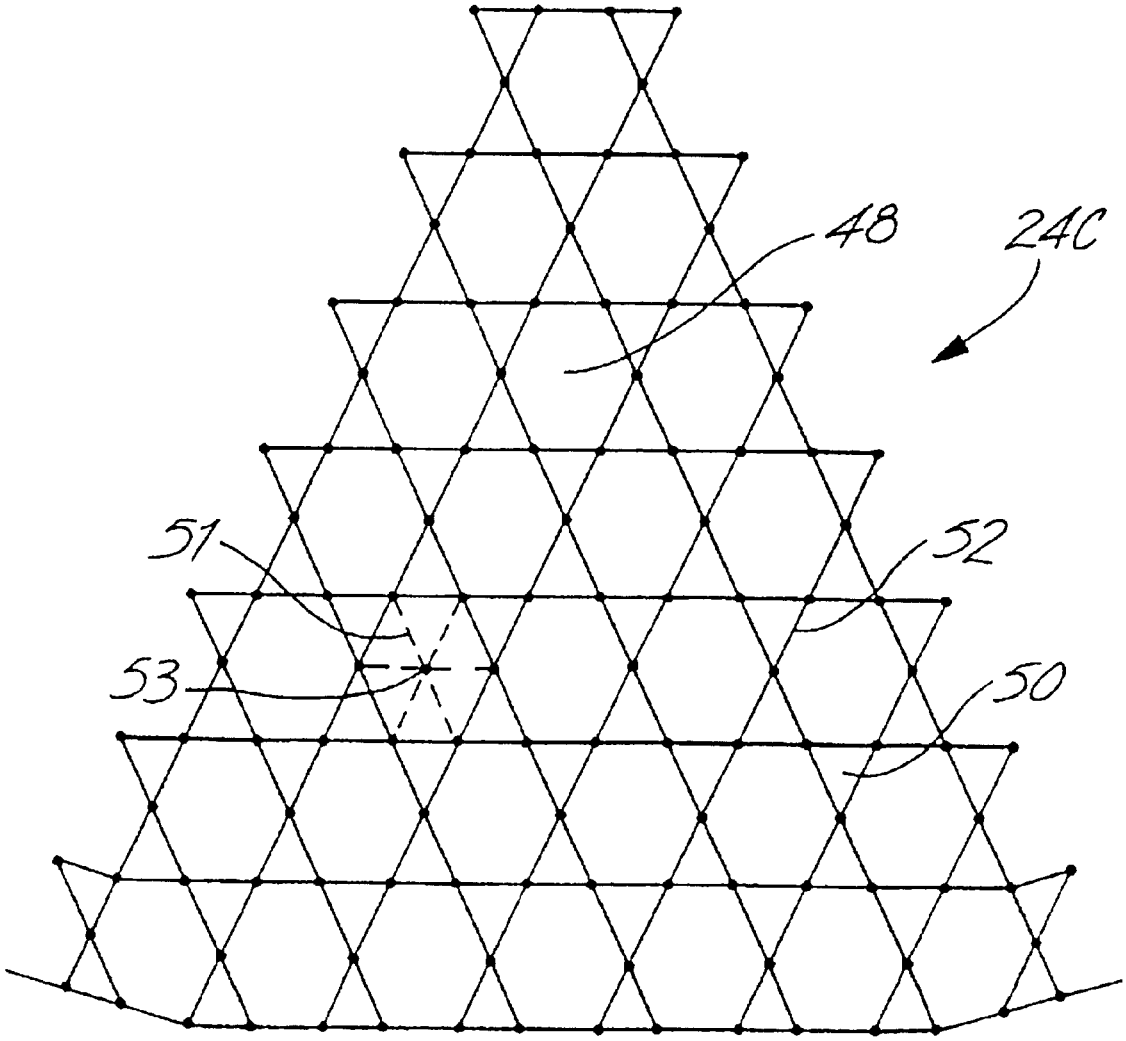
FIG. 10 is a schematic elevational view of still another arrangement for the internal network having both hexagonal and triangular shaped openings.

In FIG. 10, the internal network 24C is comprised of hexagonal 48 and triangular 50 openings. Each strut 52 forms a side of a hexagon and a side of a triangle, and four (4) struts connect to each junction. Dashed lines 51 again illustrate that the configuration is obtained by triangulating the surface and omitting a regular pattern of struts and junctions represented by dashed lines 51 and node 53 respectively. Any of these network configurations can also be used in an external network, but the fully triangulated or fully rectangulated configuration is preferred for the external network.

A preferred embodiment of a network junction is shown in FIG. 11. FIG. 11 depicts a lower (internal) network junction; an upper (external) network junction would appear as an inversion of FIG. 11. The junction comprises a circular bottom gusset plate 54 and a circular top gusset plate 56 with struts 58 interposed between the plates. The preferred strut cross section is that of a wide flange I-beam. Each I-beam strut has a central web 63 with a flange 64 at each end of the web to form an "I" shape. I-bean struts are preferred over other cross sections such as a pipe because of the greater section modulus provided by the relatively large amount of material that is positioned at the greatest distance from the center of the strut. Further, the flanges of the I-beam lend themselves well to attachment to the gusset plates. The struts 58 are fastened to the plates with conventional fasteners 60, such as load controlling bolts, which extend through holes 62 in the plates and the flanges 64 of the I-beam struts. For an internal network junction, the spacing braces 32 can be attached to the upper side of the top gusset plate 56 with flanges 66 which are affixed, as by welding, to the brace ends and which overlap the flanges 64 of the flanges of the I-beams, so that the rows of fasteners, generally designated 68, which attach the braces, connect both a flange of the I-bean and a flange of the spacing brace to the gusset plate. For an external junction, the spacing braces attach to the lower side of the bottom gusset plate in a similar fashion.

Because the junctions have top and bottom gusset plates, the junctions are able to resist moments which result from forces applied to the structure, and the networks exhibit node rigidity. Further, with a moment bearing joint, struts buckle in an S pattern while a pin-jointed strut would buckle in a parabolic pattern. The loads are distributed mainly as axially load through the struts of the networks, and any loads in the spacing braces are also mainly axially transmitted. Thus, the local moments do not propagate significantly past adjacent junctions as a moment but are converted at the moment bearing junctions into axial load in the remaining members of the networks. The moment bearing junctions also increase the load required to cause a snap through type failure of the overall dome structure. As noted more fully later herein, the upper network struts are laterally stabilized by the panels which are installed to close the upper network openings, and the stiffness of the connections between the struts in each upper and lower networks allows for removal of braces so that some of the network nodes can be unsupported.

As stated above, the internal and external networks are preferably evenly spaced from each other over the entire structure. To that end the spacing braces hold the inner and outer networks apart. Further, the spacing braces transfer small loads locally between the networks and otherwise do not aid the overall structural integrity of the dual network structure. The loads carried by the braces are very small. As a practical matter, the loads carried by the braces are local differential network loads. For example, if the struts in a given area are loaded with fifty (50) kips, the loads in the spacing braces may be as low as one (1) kip. The braces maintain the spacing between the networks and transfer local load differences between the networks, so that the inner and outer networks each bear that portion of the dome environmental and applied loads to which the network was designed. The internal and external networks then disperse and axially transmit their respective shares of total dome loads to the foundation or other support structures such as columns.

It is preferable that both the internal and external networks extend to a common foundation, but the external network and internal network may extend to separate foundations or only one of the networks may extend to a foundation. In the later case, the spacing braces near the edges of the structural system will bear relatively high loads as they transfer loads back to the network supported by the foundation.

The dual network structures exhibit shell behavior. Shell behavior, as contrasted with truss behavior, means both networks are similarly loaded in compression or tension as the case may be. Thus a load applied inwardly on the structure results in both the inner and outer networks being loaded in compression. In a truss system a top layer would be loaded in compression while the bottom would be loaded in tension.

Because the braces do not significantly help bear the dome loads, it is not necessary to use large section modulus braces. Therefore, small hollow aluminum pipe is preferred. The tubular aluminum pipes are less expensive than the I-beam extrusions and are available in many sizes. The tubular braces have a largest diameter that is smaller than the depth "d" of the associated wide flange I-beams. The tubular aluminum pipes can and preferably do have a much smaller cross sectional area and modulus than the I-beams struts.

Figure 23:
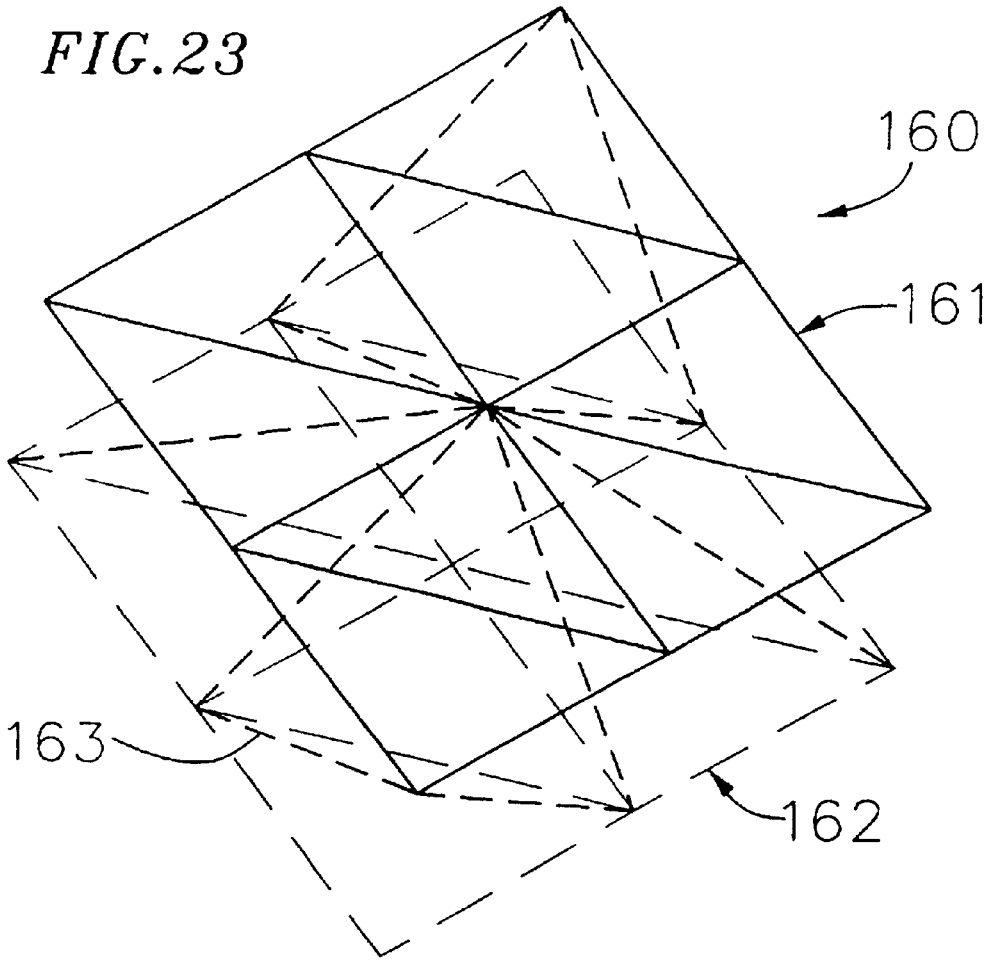
FIG. 23 is a fragmentary perspective schematic diagram of the arrangement of external and internal networks and braces in a still farther dual network system according to this invention.
Figure 24:
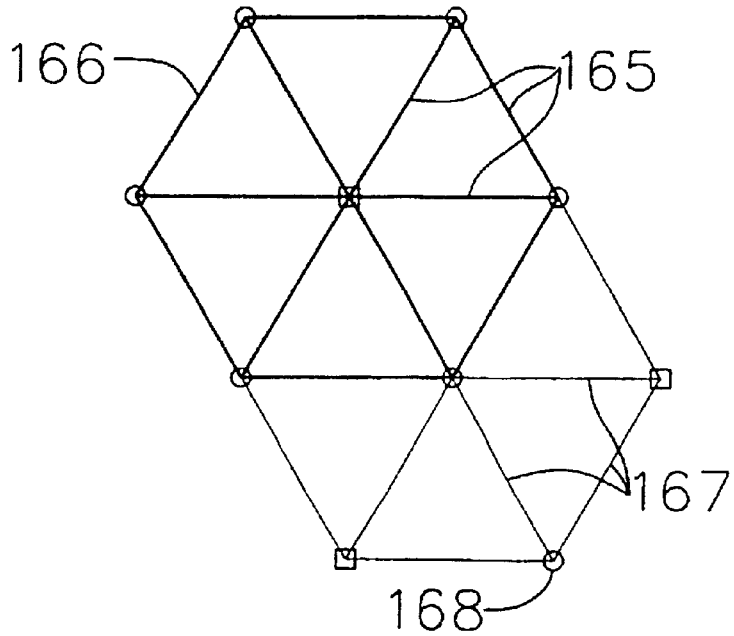
FIG. 24 is a diagram which illustrates certain relationships in the system represented in FIG. 23.
Figure 25:
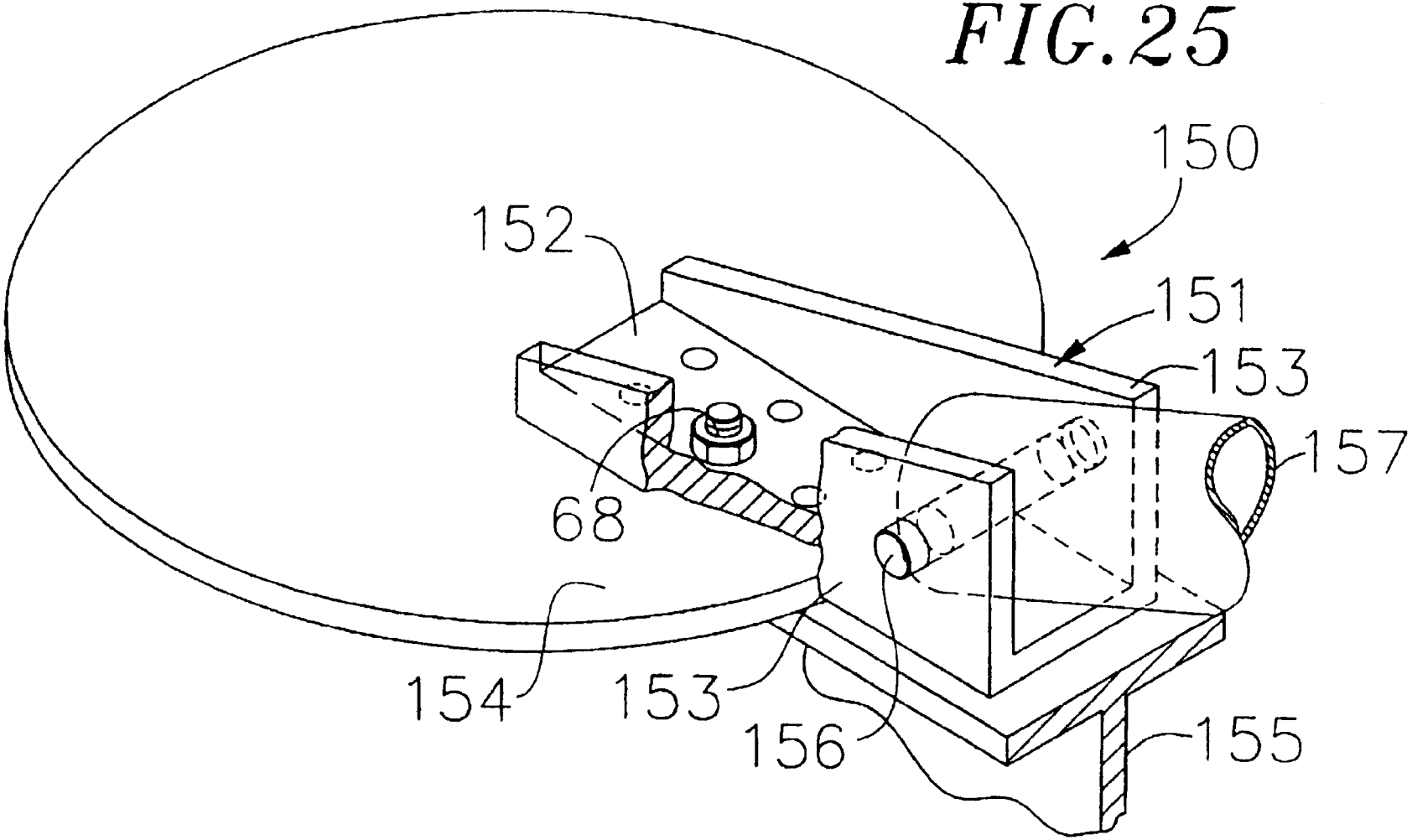
FIG. 25 is a fragmentary perspective view of a pin connection of a brace to a hub in the system of FIG. 23.

FIG. 25 illustrates an important point which is not confined to the dual network arrangement depicted in FIGS. 23 and 24. It is that the connections of braces to network junctions can be designed as pinned connections 150. A pinned connection cannot transmit moments, only axial loads, i.e., tension or compression. The fact that true pinned connections of braces to network junctions can be used in the practice of this invention demonstrates that the magnitudes and natures of brace loads are meaningfully different from the magnitudes and natures of the loads encountered and transmitted by the network struts and the network junctions.

Depending on the configuration of the internal network, the number of spacing braces attached to each junction can vary. In the embodiments of FIGS. 3 and 7, three spacing braces 32 extend from each external junction 36 to three adjacent internal junctions 40. The same is true for the internal junctions. Three spacing braces extend from the internal junctions to the three adjacent external junctions. In the embodiment shown in FIG. 8, the internal junctions have three spacing braces extending therefrom to the three adjacent external junctions, but because nodes have been omitted in the internal network, each external junction has two spacing braces extending therefrom to different adjacent internal junctions. In the embodiment of FIG. 10, the internal junctions again have three spacing braces extending therefrom to the three adjacent external junctions, and like the embodiment of FIG. 8, some nodes have been omitted. However, not as many nodes have been omitted in the embodiment of FIG. 10. Therefore, some of the external junctions have three spacing braces extending therefrom and others have two spacing braces extending therefrom. In both cases, the braces extend to different and adjacent junctions of the internal network.

The kinds of dual network arrangements described above have the unifying characteristic that their networks are out of phase. That is, that the junctions in the upper and lower networks are not aligned along a common line from the common center of curvature of the dome in the case of domes having spherical or similar curvature, or are not aligned along common lines normal to a common axis of symmetry in the case of domes having cylindrical or similar curvature. FIGS. 23 and 24 depict a dome structure 160 in which the upper and lower network surfaces are identically reticulated (triangulated, in this instance) and the lattice of one network is superimposed (projected) upon the lattice of the other network. In this latter second kind of dome according to this invention, corresponding nodes are aligned along common radii from the center of curvature or along common perpendiculars to the structure's surface. Thus, the networks are in phase. This relationship is shown in FIG. 23 which is a fragmentary schematic view (with perspective attributes) of a portion of a dual network arrangement in which the network lattice arrangements arm the same and are superimposed.

In FIG. 23, the solid lines represent struts in the upper network 161, the relatively light broken lines represent struts in the lower network 162, and the relatively heavy broken lines represent braces 163 between the networks. In related FIG. 24, the heavy lines represent upper network struts 165 and their junctions 166, and the lighter lines represent lower network struts 167 and their junctions 168. FIGS. 23 and 24 illustrate a characteristic of this kind of dual network arrangement, namely, that only one junction in each pair of aligned (registered or superimposed) junctions has braces connected to it, and those braces lie in planes defined by the parallel upper and lower strut members. In FIG. 24, lower network junctions which have braces connected to them are circled, and upper junctions which have braces associated with them are encompassed by squares. Each braced junction in a network is in the center of a hexagon of unbraced junctions in that network. There are no aligned unbraced junctions. Each braced junction in the upper network typically has six braces connected to it. Each braced junction in the lower network typically has three braces connected to it.

FIG. 25 shows that the braces in dual network dome structural systems of this invention can have pinned connections 150 at each of the junctions to which the individual braces are connected. A brace coupling member 151 is generally in the form of a channel having a base 152 and spaced walls 153 perpendicular to the base. The base is conveniently secured to a junction gusset plate 154 by use of the same bolts or other fasteners 68 used to secure an adjacent network strut 155 to that gusset plate. A pin 156 is suitably held in a pair of aligned holes in the opposite side walls 153 and passes through a passage formed through a brace 157 near its end. The pin is disposed perpendicular to the length of the brace. Pinned connections like those shown in FIG. 24 can be used in place of the brace connection structures shown, e.g., in FIG. 11 and 22 if desired.

The synergistic combination of the two networks and the spacing braces enables construction of a rigid low profile structure capable of spanning distances of 900 feet or more while supporting substantial equipment loads. This combination also permits the use, even for such large spans, of aluminum I-beam extrusions in readily available sizes. The preferred sizes have depths "d" between ten (10) and fourteen (14) inches. Further, the same size struts can be used throughout the networks. Therefore, with the exception of features such as those shown in FIG. 26 on the top surface of the external struts which form components of the closure system for the openings in the network, each strut has a substantially uniform transverse cross section throughout its length, and the struts all have substantially the same depth. Though the inner and outer networks can use I-beams with different depths, it is preferred, for simplicity, that both the inner and outer networks use the same size I-beams. Still further, the synergistic combination allows construction of relatively low profile structures having large or small spans, and if a free span structure is not required, the present invention can be utilized to construct enormous structures or extremely low profile structures having vertical supports, such as columns, extending from the structure to the foundation.

The discussion of the spherical dome shown in FIGS. 1 and 2 is pertinent to the following description of other dome structures having different overall contours. Therefore, the following discussion of these further structures focuses on features of contour which distinguish them from the spherical dome. In the spherical dome, the internal and external networks are preferably concentric. In the following structures, the internal and external networks preferably have common volumetric centers and common centers or axes of curvature for the different external and internal network contours.

Figure 12:
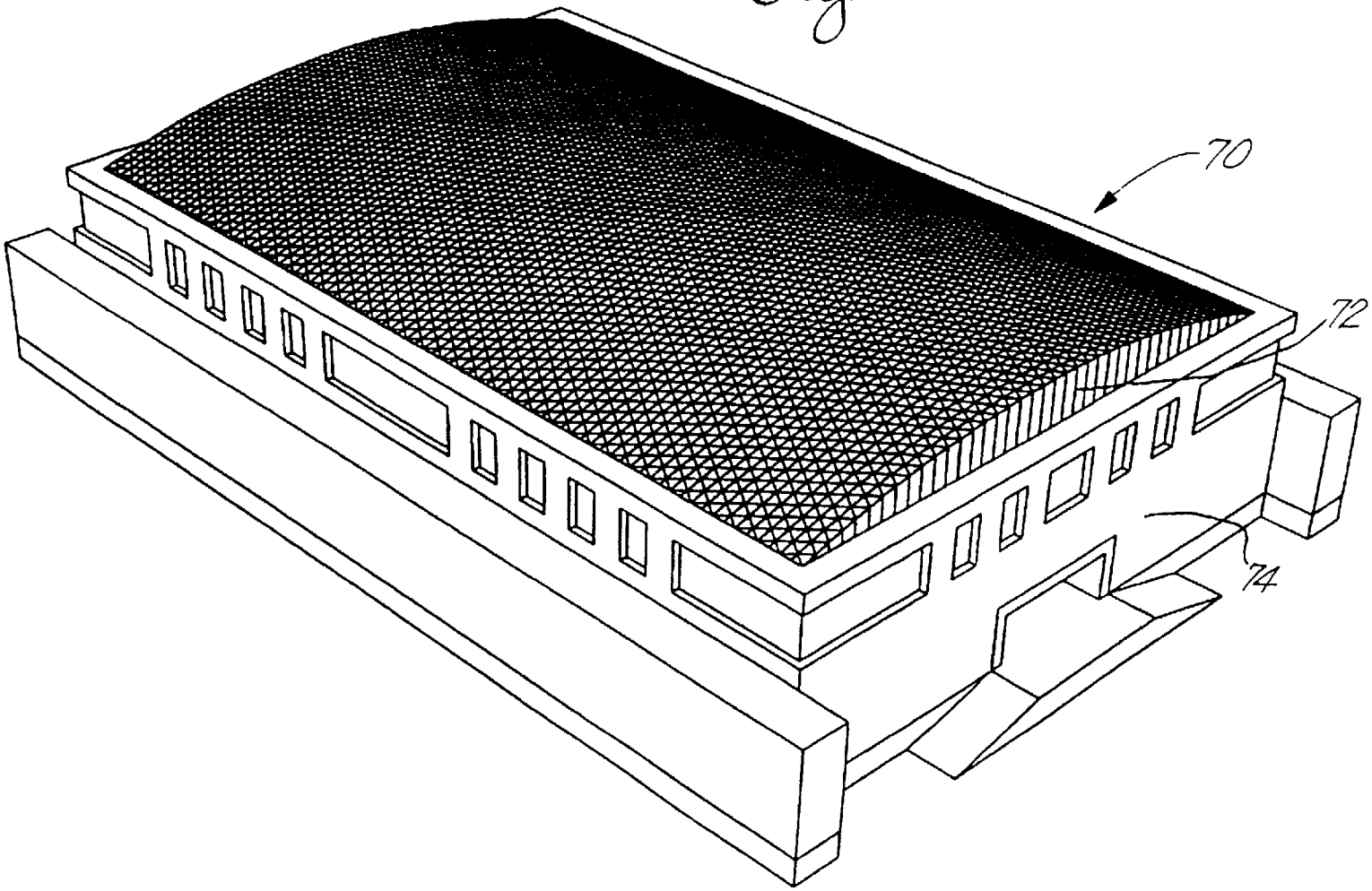
FIG. 12 is a perspective view of a building having a roof comprising a dual network vault shaped reticulated structural system.

FIG. 12 is a perspective view of a dual network structural system of vault style, generally designated 70, with the outer network fully triangulated. The ends 72 of the vault are vertical walls which extend downwardly from the circularly cylindrical or other arched profile of the vault to the foundation 74. In the embodiment shown, the foundation is a building, and the vault is secured to the top of the building's outer wall. However, other foundations such as vertical walls, a sliding track, the ground, or a concrete slab will function as a foundation for the spherical dome, the vault, the following structural systems, and others.

Figure 13:
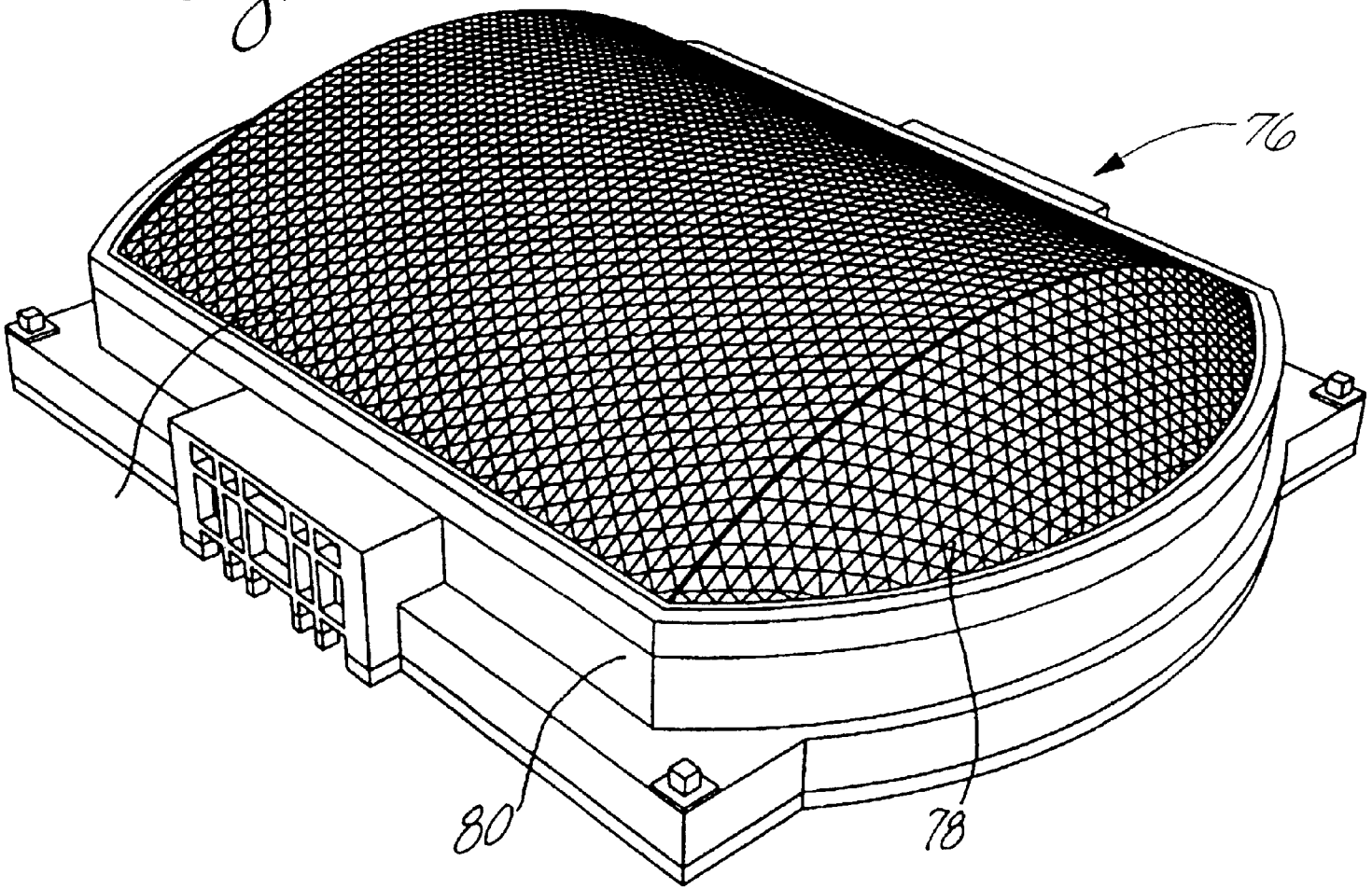
FIG. 13 is a perspective view of a building having a roof comprising a dual network vault shaped reticulated structural system with rounded ends.
Figure 14:
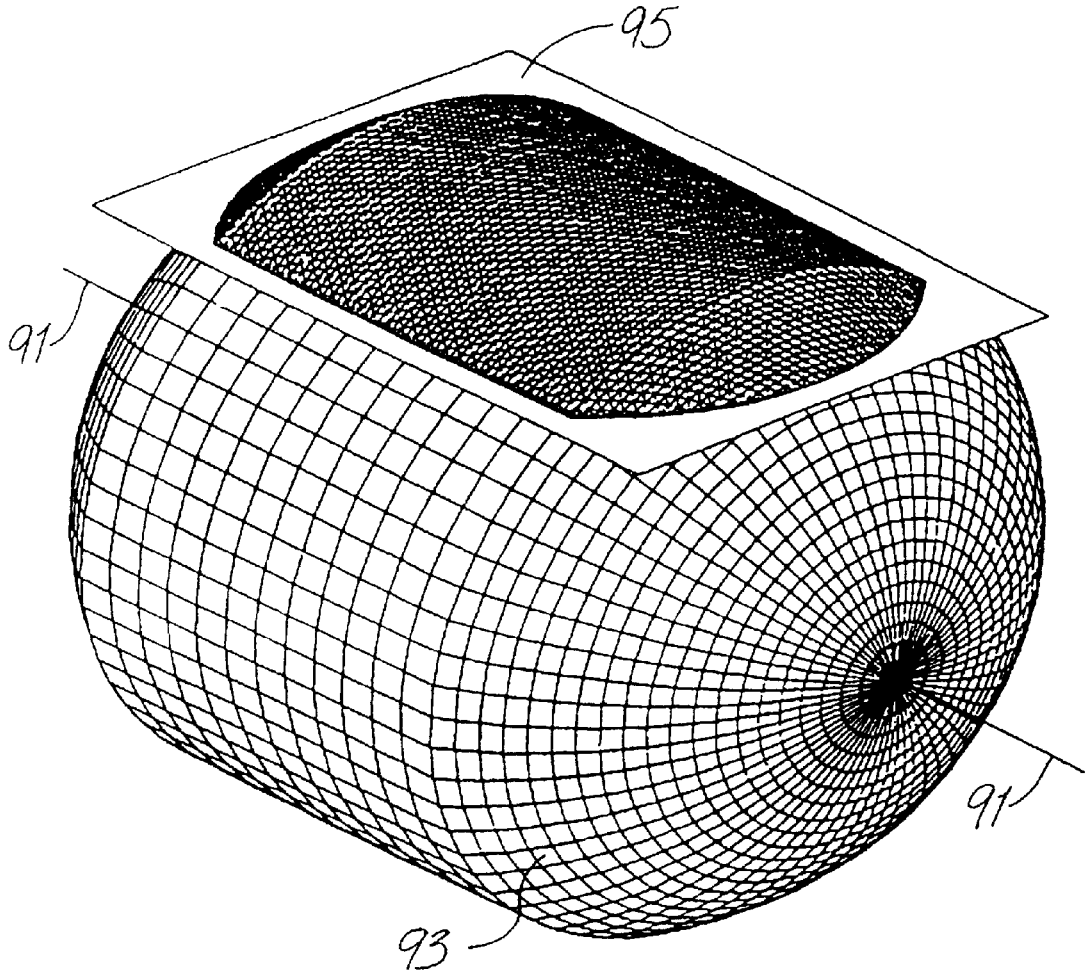
FIG. 14 is a schematic perspective view illustrating a step in designing the structure of FIG. 13.

FIG. 13 is a perspective view of a dual network structural system of vault style, generally designated 76, with rounded ends 78 and the outer network fully triangulated. The ends 78 of the vault are preferably of spherical curvature and have a radius of curvature larger than the radius of the cylindrical body 79 so that the intersections between the ends and the vault body are not smooth, but other arcs can be used for both the vault and ends. If the curved ends have the same radius as the cylindrical body, the transitions between the ends and body will be smooth. This is desirable because the smooth transitions will cause the structure to exhibit shell behavior. The foundation 80 again comprises a building, and the reticulated structure is fastened to the top of the outside wall of the building. Referring additionally to FIG. 14, the shape of the structural system is obtained as a part of a surface of revolution 93. An imaginary plane 95 is passed through the surface of having an axis of symmetry 91 revolution and positioned so that the line of intersection of the plane with the surface has a foot print equivalent to the supporting structure or foundation 80.

Figure 15:
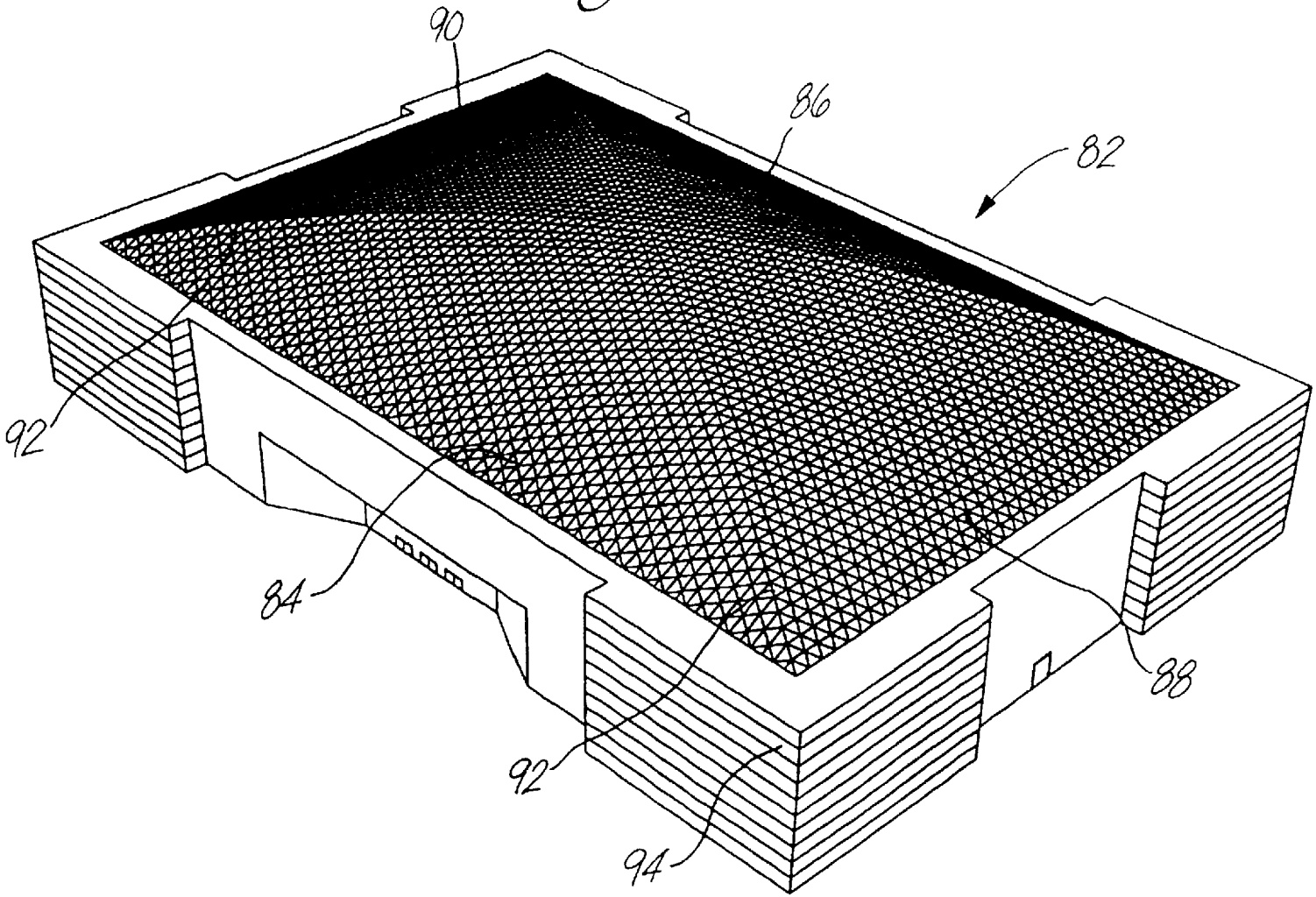
FIG. 15 is a perspective view of a building having a roof comprising an intersecting vault shaped dual network reticulated structural system.

FIG. 15 is a perspective view of a dual network structural system of intersecting vault style, generally designated 82. An intersecting vault comprises four arcuate regions 84, 86, 88, 90. All four regions can have a different curvature, but in the preferred embodiment shown, the opposing arcuate regions have the same curvature. Thus, the front 84 and back 86 regions have the same curvature, and right 88 and left 90 regions have the same curvature. Similar to the other vaults, the foundation 94 shown is a building. The vault structures are especially useful for substantially rectangular or other four sided applications such as libraries, museums, and convention centers, and aluminum is ideal for natatoriums. These applications frequently require spans on the order of 600 feet and greater. Prior to the development of the dual network structures of the present invention, reticulated aluminum structures could not be used in these large span applications. Thus, the disclosed dual network dome technology can reduce the cost of buildings and the maintenance costs of buildings by making economically feasible reticulated structures strong enough to cover large spans and composed of structural elements of modest size which are relatively readily obtainable.

Figure 16:
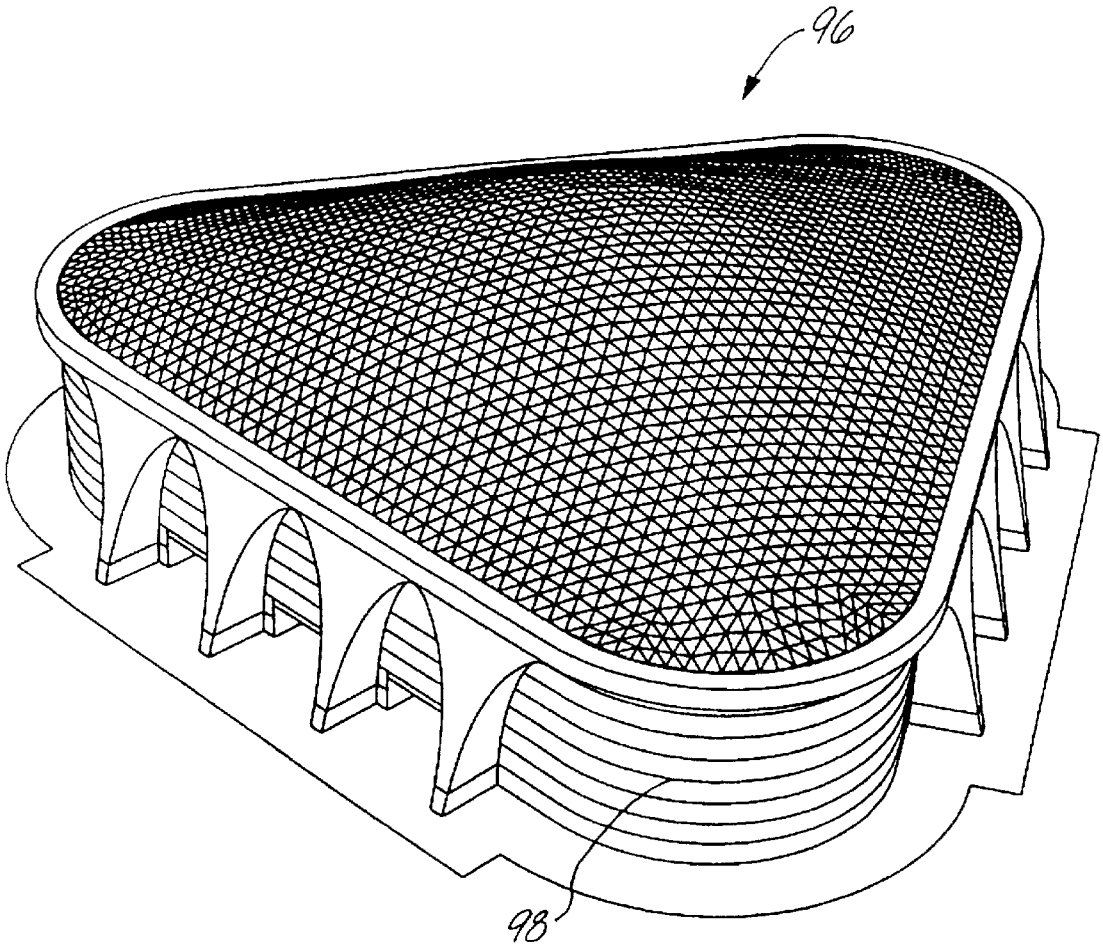
FIG. 16 is a perspective view of a dual network triangular shaped reticulated structural system that is covering a baseball stadium, e.g.

FIG. 16 is a perspective view of a triangular grid dual network triangular structure, generally designated 96. This shape can be described as a triangle or deltoid with rounded vertices. The triangular structure is useful to cover baseball stadiums, and in the embodiment shown, the baseball stadium is the foundation 98 for the triangular structure. With the capability to cover large spans and the simplicity of the dual network structure, it is economically and structurally feasible to add roofs to existing baseball stadia.

Figure 17:
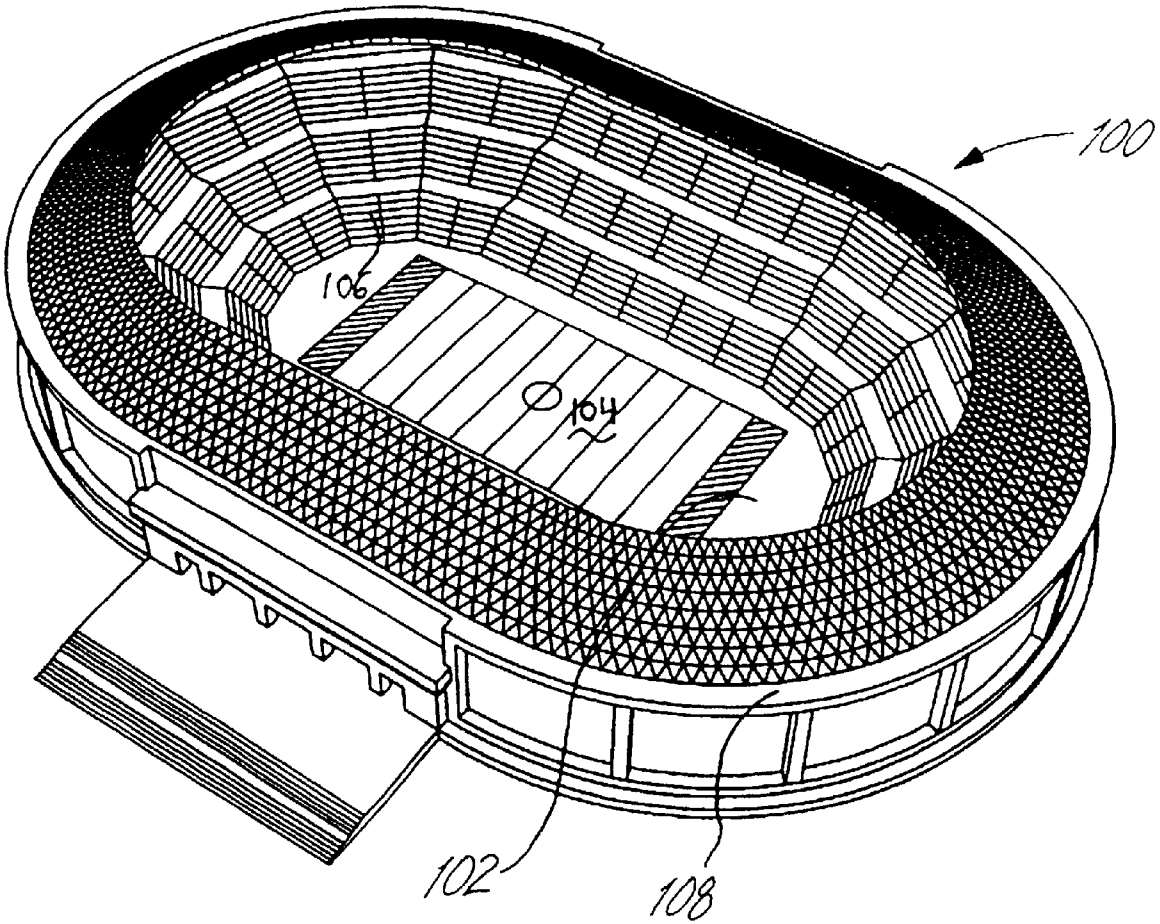
FIG. 17 is a perspective view of a stadium shape dual network reticulated structural system having a central opening.

FIG. 17 is a perspective view of a triangular grid dual network, stadium shaped (elongate oval) annular structural system, generally designated 100, with a central opening 102. Stadium shape as used herein refers to a structure covering the outer portion of the foundation leaving the central opening; there is no dome structure over the playing field 104, but the seats 106 in the stadium can be or are covered. As with the above structures, the stadium serves as the foundation 108 for the reticulated domelike structure.

Figure 18:
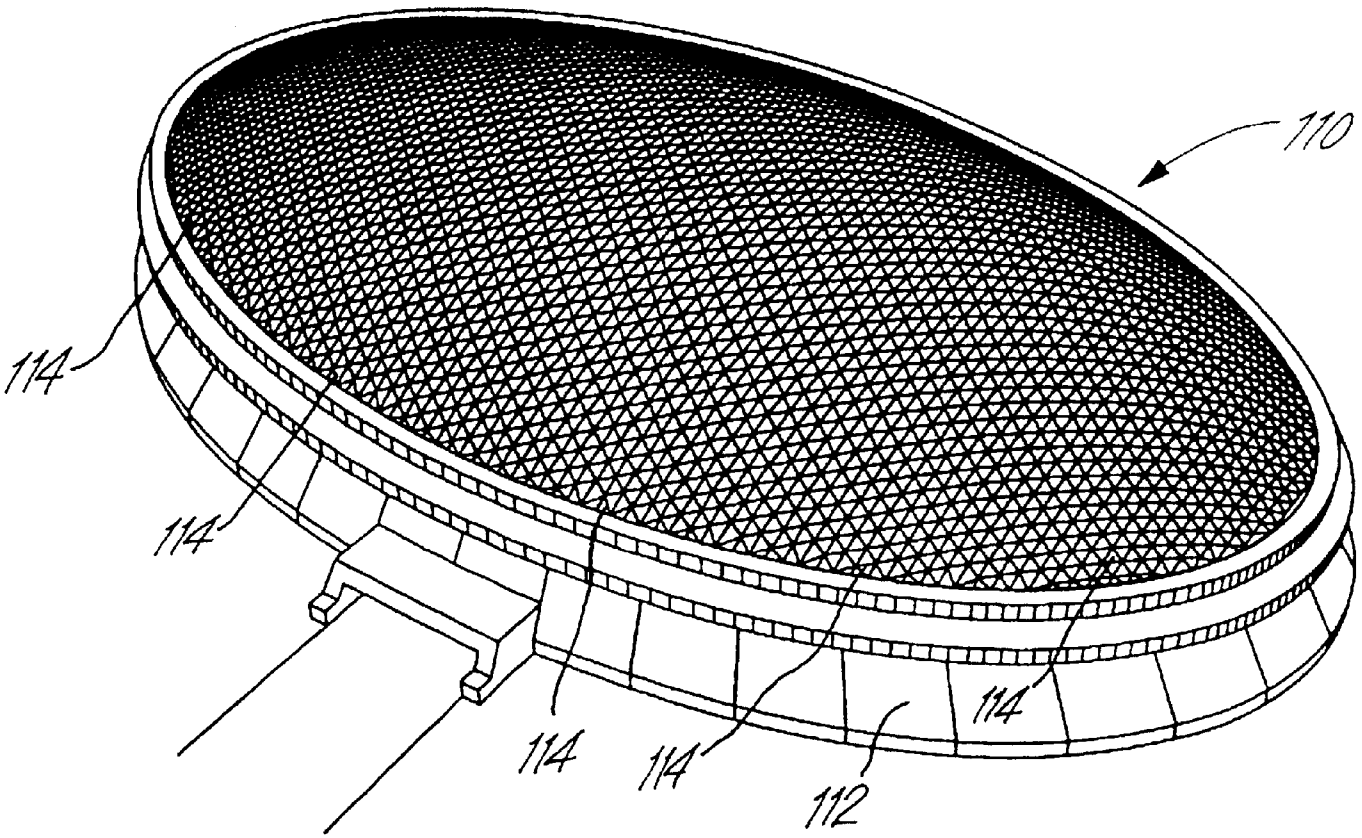
FIG. 18 is a perspective view of a dual network ellipsoidal shaped reticulated structural system covering an elliptical building.
Figure 19:
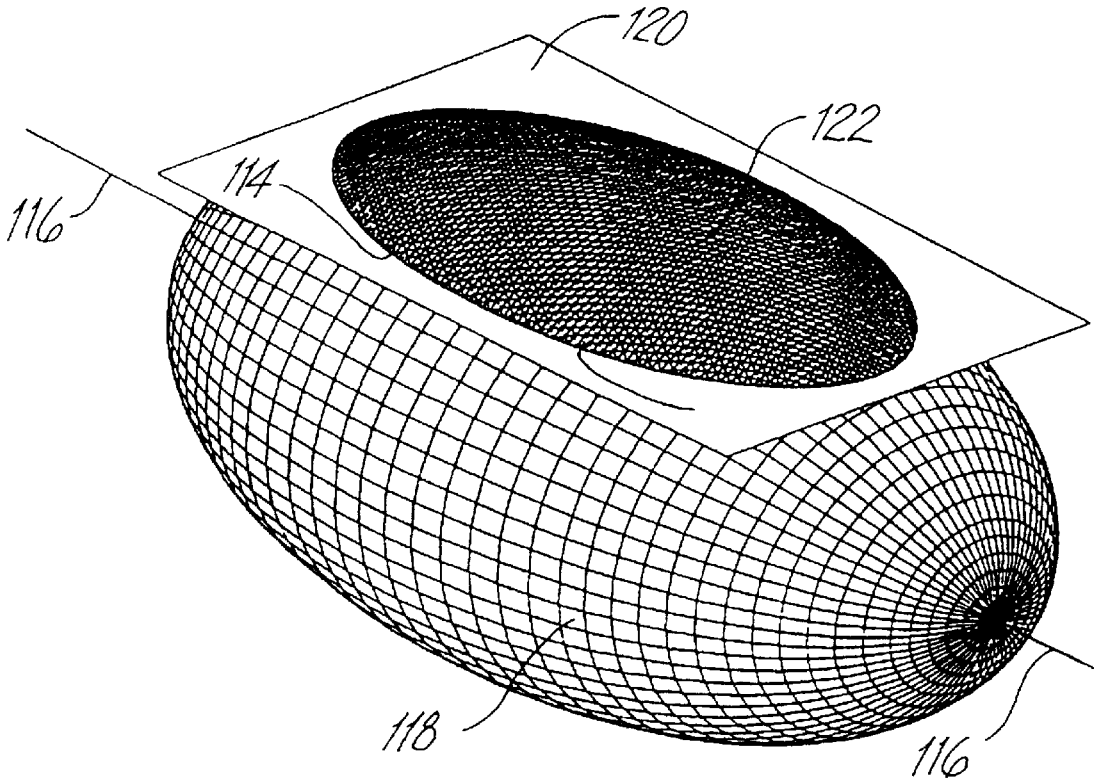
FIG. 19 is a schematic perspective view illustrating a step in designing the structure of FIG. 18.

FIG. 18 is a perspective view of a triangular grid dual network ellipsoidal structural system, generally designated 110. The ellipsoidal structure is supported on a foundation 112 which is a building or a stadium having an elliptical footprint foundation. Referring additionally to FIG. 19, the contour of the dome structure is obtained by rotating a desired closed shape, here an ellipse, about a major axis 116 creating an ellipsoidal surface of rotation 118. An imaginary plane 120 is passed through the surface of revolution to obtain the contour of the structural section 122 of the surface of revolution, and the plane is positioned so that the line of interaction of the plane with surface 118 corresponds to the plan shape of the foundation 112. The structural portion is then reticulated (subdivided) into polygonal geometric shapes such as squares, rectangles, triangles, and other shapes. The plane 120 is replaceable with a representation of the actual foundation, so that the structural design is determinable for a nonplanar foundation. Each row of elements 114 of the ellipsoidal structure normal to the axis of revolution 116 is a partial cone. The cones intersect smoothly to complete and define the overall dome structure. Thus, the cones combine to form an elliptical footprint to match the elliptical shape of the foundation. This approach to subdividing the surface greatly simplifies a method used to obtain an ellipsoidal configuration. Further, using the simplified elliptical structure in combination with the dual network technology, permits ellipsoidal shaped structures to be used in large span applications such as football stadiums.

Figure 20:
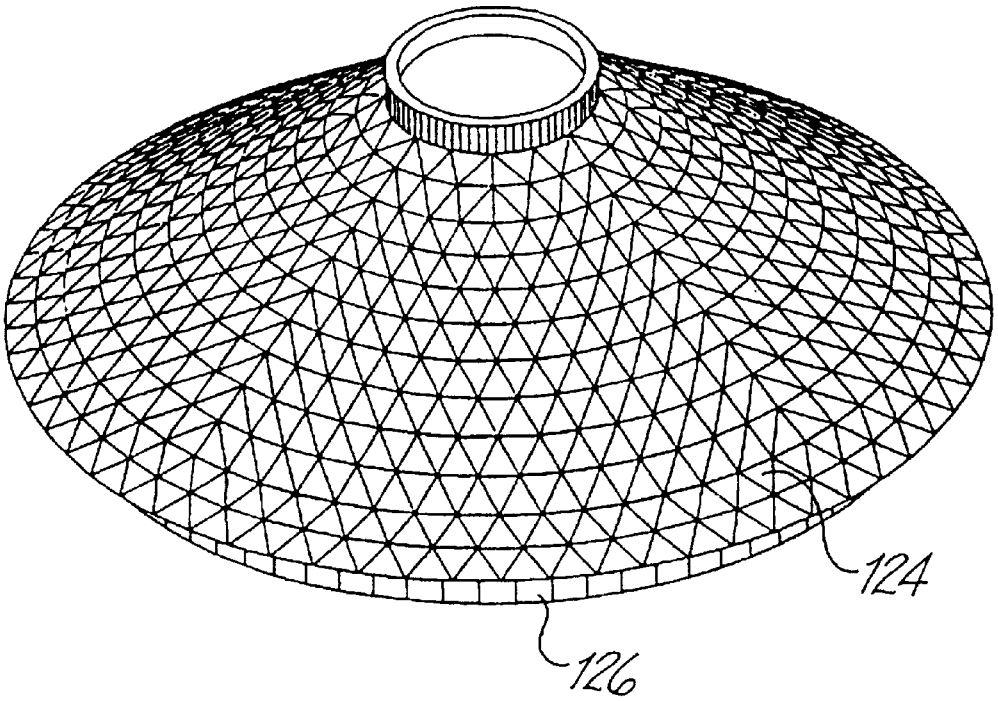
FIG. 20 is a perspective view of a conically shaped dual network reticulated structure.

Still another structural system is shown in FIG. 20. The dual network structure 124 of FIG. 20 is conical in shape and extends beyond its foundation 126. These various embodiments illustrate the design versatility of the present invention.

Figure 27:
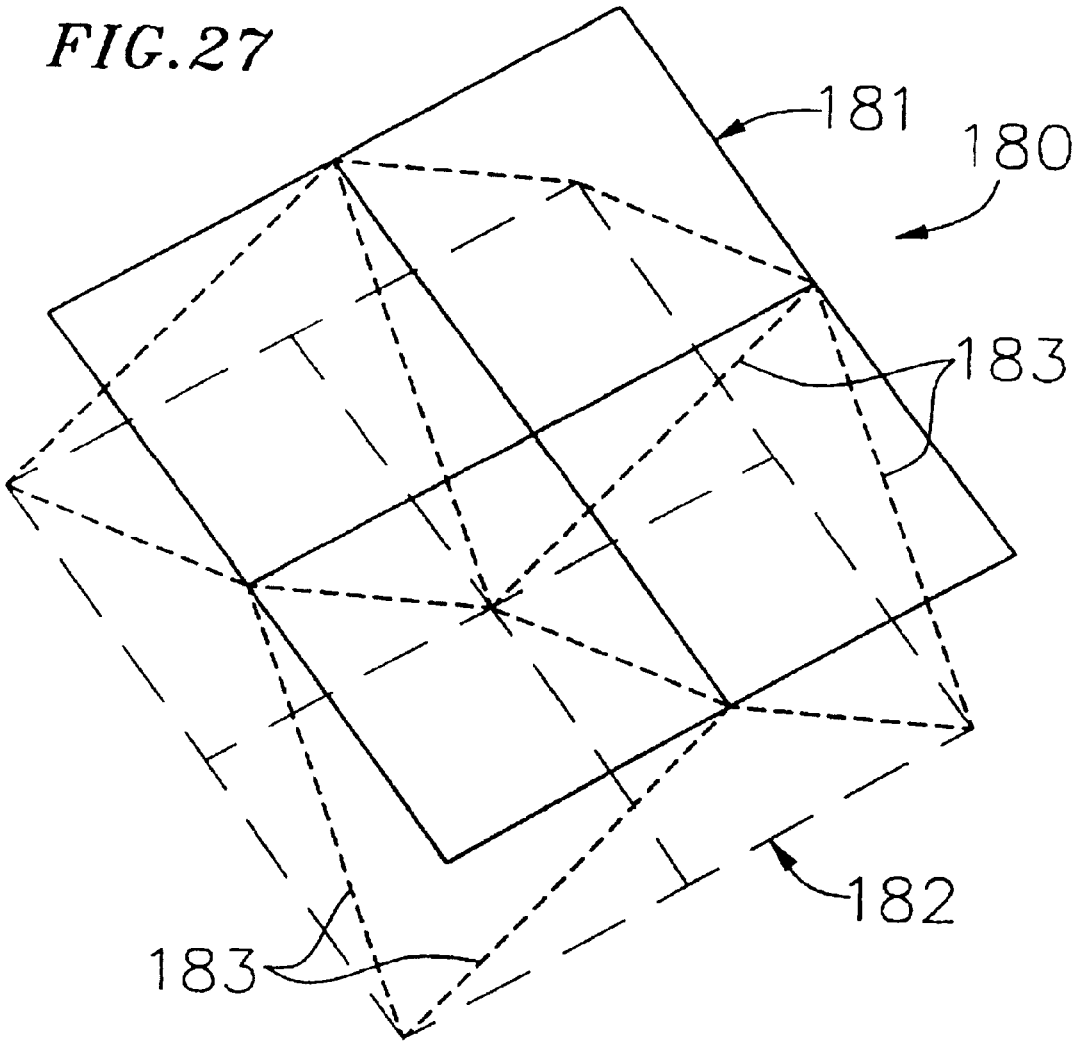
FIG. 27 is a fragmentary schematic diagram the arrangement of network struts and braces when the networks are in phase relative to each other.

FIG. 21 illustrates a structural system 128 that is divided (reticulated) into rectangles 130 instead of triangles. System 128 is well suited for applications where the overall contour of the dome is cylindrical and the axis of the cylinder is parallel to the shorter sides of the rectangles. System 128 has upper struts 132 forming an upper network and lower struts 134 forming a lower network. For sake of clarity, not all of the lower struts are shown. The inner and outer networks are connected by spacing braces 136 connected at nodes 138. In this embodiment, the inner and outer networks are out of phase. That is, the nodes of each network are not aligned with a line normal to and extending from the centroids of the openings of the other network. However, in-phase rectangulated dual network structural systems can be used if desired, as shown in FIG. 27. FIG. 27 schematically shows a typical portion of a structure 180 in which both an upper network 181 and a lower network 182 have rectilinear grids defining square openings between their respective struts. For each aligned pair of junctions in the networks, only one junction has braces connected to it, namely, four braces 183. In each network, braced and unbraced junctions alternate with each other along each grid line. The braces lie in the planes defined by aligned parallel struts in the respective networks. As a consequence, the braces can be connected to the network junctions by use of the same fasteners which are used to establish non-welded connections of the struts of their respective networks to their junctions; that is a beneficial characteristic of in-phase networks which have the feature that braces lie in planes defined by parallel struts at corresponding locations in the two networks.

Figure 22:
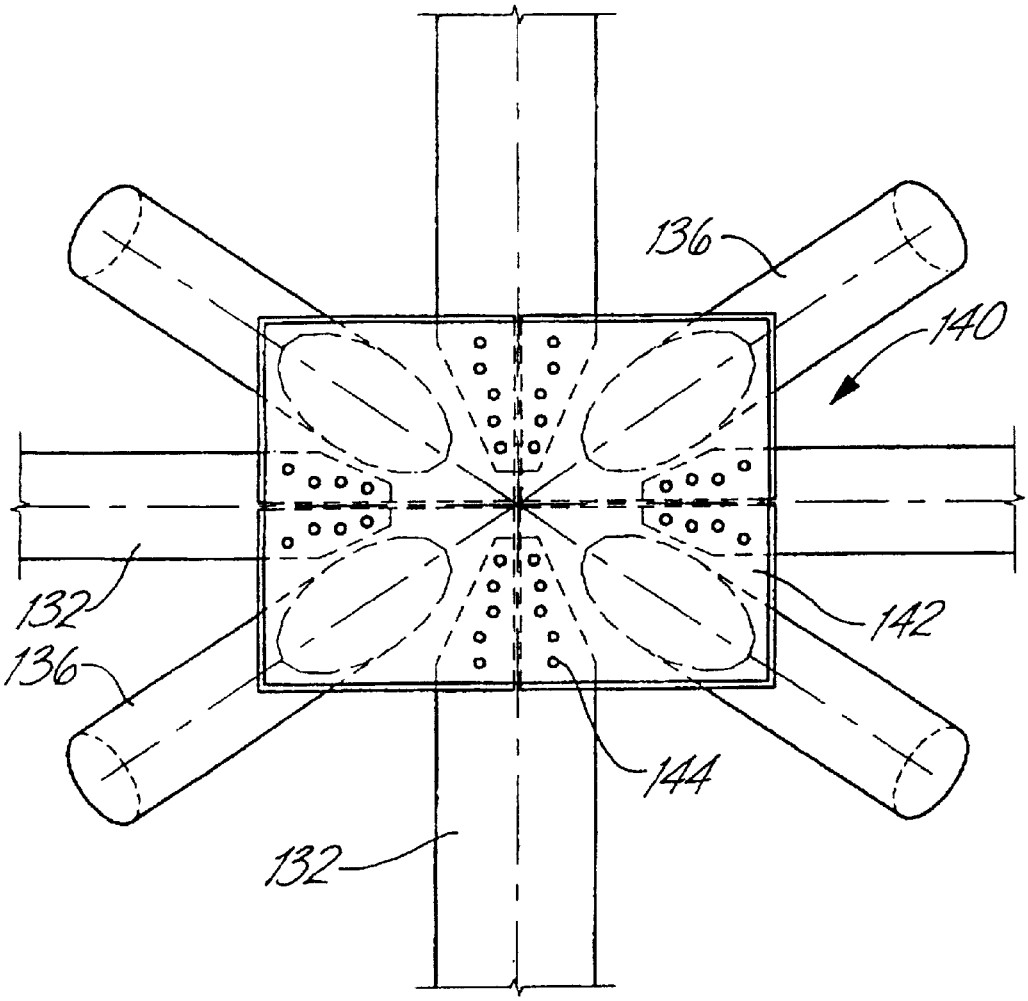
FIG. 22 is a top plan view of a junction of the dual network structural system of FIG. 21.

FIG. 22 shows a junction, generally designated 140, similar to the junction shown in FIG. 11, which can be typical of a network junction in system 128. In this embodiment, a top gusset plate 142 and bottom gusset plate (not shown) are rectangular, have four struts 132 attached to the respective sides and four spacing braces 136 extending diagonally from the corners. The spacing braces and strut members are connected to the gusset plates with fasteners 144.

Figure 26:
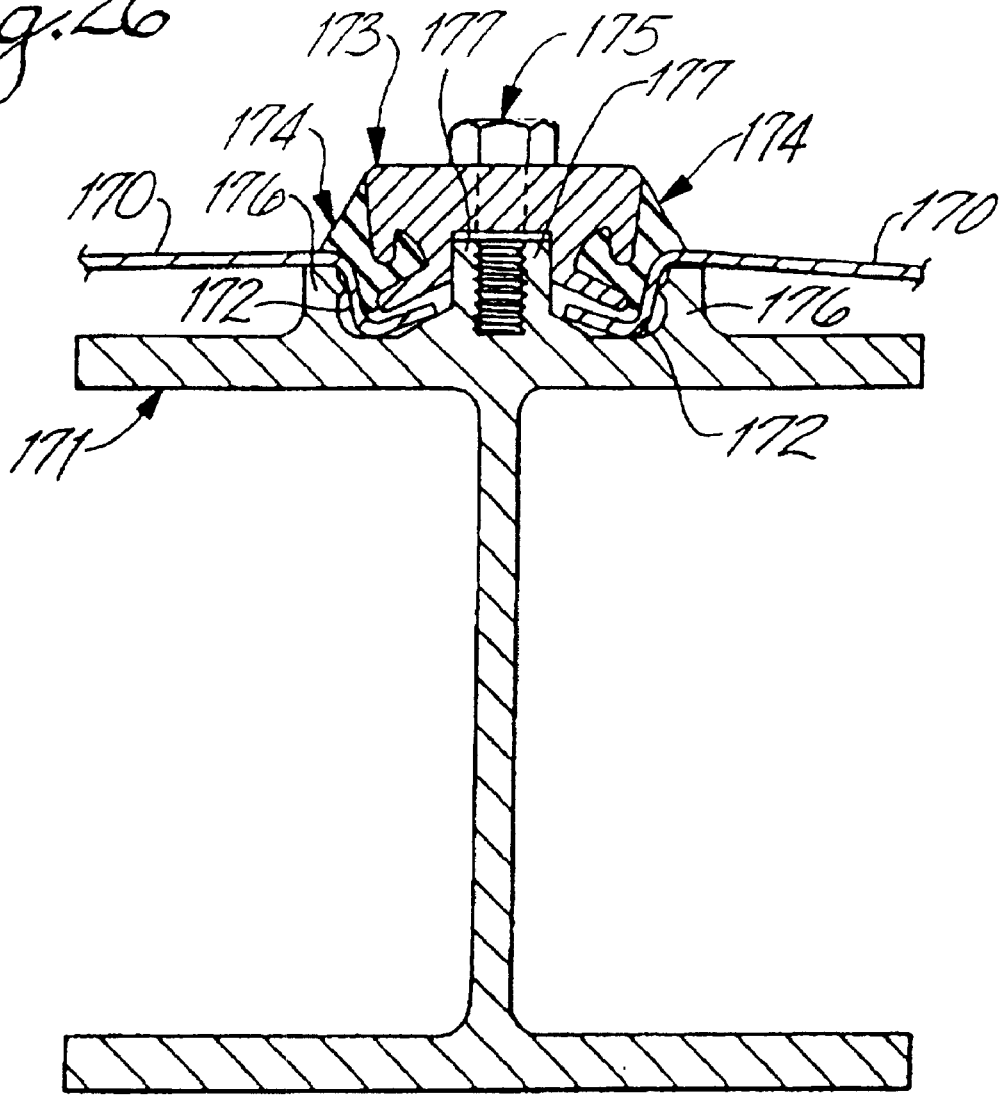
FIG. 26 is a fragmentary cross-sectional elevation view of a network closure and roofing subsystem which is useful in a dual network structural system according to this invention.

FIG. 26 is the same in essential content as FIG. 6 of U.S. Pat. No. 3,909,994, to which drawings and the related text of that patent reference is made. FIG. 26 shows the connection of a pair of sheet metal preferably aluminum) closure panels 170 to related features defined in the upper portion of a preferred upper network strut 177 in the practice of this invention. The closure panels have a platform shape which conforms to the triangular or rectangular upper network openings of which the strut forms a boundary. Except at its corners where each panel is differently fabricated for sealing at a junction in the manner described in U.S. Pat. No. 3,909,994, each edge of each panel is contoured 172 to define an offset margin for cooperation in a corresponding one of a pair of upwardly open longitudinally extending recesses defined by the strut's upper structure. When so disposed in a recess, the panel margin is clamped to the strut, together with the panel closing the network opening on the other side of the strut, by a batten 173 which carries resilient gasketing 174 along both of its opposite long edges. The batten is secured to the strut by a series of screws 175 or other threaded fasteners passed trough the batten at intervals along its length into treaded engagement with the opposing longitudinally serrated surfaces of a-third upwardly open central recess formed in the upper portion of the strut, preferably in the course of manufacture of the strut by an extrusion process. The recesses are defined between two suitably contoured outer ribs 176 and two inner ribs 177, all of which are parallel to each other.

As shown by FIG. 26, the clamping of the closure panels to the upper network strut is achieved in such a way that the panels structurally augment the struts by supporting the struts laterally against buckling. The network, preferably the upper one, to which the panels are connected to form a roof over the space enclosed by the dual network dome structure does not merely support the roof, it integrates the roof into the dual network arrangement. Such integration contributes to the beneficial behavior of the dual network and to the economic benefits of the dual network dome.

FIGS. 11, 22, and 25 illustrate a point which is important in the context of aluminum structural systems. It is that the connections between struts in each network are non-welded connections, and the connections of the braces to the networks do not rely on the use of weldments in any places which can affect the network struts or the network strut connection arrangements. The structural properties of aluminum are so affected by welding that good structural design principles require a substantial reduction (on the order of 50 percent) in the stresses allowable in welded elements. While welding of connection flanges or plates to braces is depicted in FIGS. 11 and 22, those welds are in locations which do not affect the network struts and their interconnections. Thus, struts of reasonable depths and availability can be used effectively and efficiently in the dual network dome structures of this invention. Most known space frame Systems, on the other hand, have some form of welded connection between their structural elements.

Environmental loads, such as wind or snow loads, applied to the closure panels in the finished dual network dome are transferred to the boundary struts as bending loads on the struts. That bending moment in any strut is transmitted by the moment-stiff, rather than moment compliant, strut junctions to adjacent struts essentially as an axial load in the adjacent struts. In struts three or four nodes removed from a given strut subjected to bending loads, the transferred loads from the given strut are seen purely as axial loads. Also, to the extent either of the networks in the dual network arrangement locally carries a disproportionally high local load due to environmental loads or internal applied loads, such local network load differentials are distributed between the networks by axial loads in the braces in and closely around that area.

Workers skilled in the art to which this invention pertains will note that, while conceptually and structurally very different, dual network arrangements according to this invention have load carrying behaviors akin to the load carrying behaviors of honeycomb panels in which the face sheets carry similar loads and the honeycomb core carries minimal loads while maintaining the face sheets in the desired parallel or other spaced relation.

The present dual network dome structures can be used for roofs of double curvature having spans of over 900 feet, and for roofs of single curvature having spans of over 600 feet. Because of those large spans and the range of shapes which the dual network structures make possible, and because of the weight of such domes, such large span dual network structures cannot be constructed with the central tower method previously described. However, the rigidity of the dual network structure permits large subassemblies of the structure, in the order of approximately 100 feet by 60 feet and greater, to be constructed at ground level and raised into position where they can be connected to the foundation or previously erected portions of the structure. Further, subassemblies can be constructed away from the construction site and transported thereto.

A preferred method of construction utilizing the dual network concept of this invention comprises constructing, as a series of subassemblies, an outermost section of the reticulated structure, and positioning the outermost section in a desired attitude and position, which is preferably its final position, relative to the foundation. It often will be convenient to assemble an outermost dome section around the entire perimeter of the dome and positioned relative to the foundation on suitable shoring. For most applications, it is preferable that the initially assembled portions of the dome be attached to the foundation before proceeding. Internal subassemblies or other outermost subassemblies of the structure are then assembled at ground level and raised into position relative to the previously erected subassembly or subassemblies by a crane or cranes. The subassemblies are then attached in the desired place to the previously erected portion of the structure and supported with additional shoring if required. Several internal subassemblies are preferably raised and attached substantially simultaneously, and preferably the internal subassemblies are attached so that the edges of construction of the structure are always substantially the same height. The subassemblies are constructed so that they include at least three junctions but far larger subassemblies are preferred. The subassemblies shown in FIGS. 3, 5, and 6 include up to 31 junctions. Each subassembly includes a portion of the external network and a portion of the internal network connected by the spacing braces. This provides a subassembly with sufficient bending stiffness for erection by this method. Further subassemblies are repeatedly constructed and attached to the previous subassemblies until the structure is completed.

Alternatively, a portion of the structure is completed that extends from one point on the perimeter of the structure to an opposite point on the perimeter of the structure. This sequence attaching the subassemblies may be preferable for some forms of domes. A mobile man-lift is used to lift workers to the junctions where the subassemblies are being connected. In the conventional method, the mobile man-lift must lift workers to every connection point of the structure. Thus, in the present method, the workers spend far less time working high above the ground. This method of erection also minimizes the amount of shoring because of the high bending stiffness of the installed portions of the dome and of he subassemblies to be added to them.

The aluminum dual network construction is rigid, and therefore, a large subassembly suspended by a crane for positioning and attachment does not deform as a less rigid single network structure would. For example, a single network structure or a structure without moment bearing junctions would be insufficiently rigid for successful construction by this method. Further, the rigidity of the dual network structure substantially reduces the need for shoring the structure during construction. Thus, the time required to construct the dome structures, the scaffolding and shoring materials required, and the time working high off the ground are all reduced by this construction method which is made possible by the high bending rigidity of the disclosed dual network reticulated structural systems.

Thus, dome structures are disclosed which utilize two preferably concentric and similar structural networks to dramatically increase the span which is practically and economically feasible for reticulated structures to cover. A method of construction is disclosed which utilizes ground construction of portions of the structure to more efficiently and safely construct large span reticulated structures and reticulated structures of varying shapes. Further, ellipsoidal and other differently contoured dome structures are described which utilize a plurality of cylindrical or other regularly curved sections to more efficiently construct a reticulated structure having an elliptical or other desired footprint. Still further, a method of designing dome structures is disclosed which utilizes a surface of rotation divided by a plane to define the overall shape of the structure. While preferred embodiments and particular applications of this invention have been shown and described, it will be apparent to those skilled in the art that other embodiments and applications of this invention are possible without departing from the fair scope of this invention. It is, therefore, to be understood that, within the scope of the appended claims, this invention may be practiced otherwise than as specifically described.

What is claimed is:

1. A reticulated dome structure supportable on a foundation and comprising:

an external structural network in an outer surface of desired contour and including a plurality of external struts connected at moment-stiff external junctions, the external network subdividing the outer surface into external network openings of essentially uniform polygonal kind, an internal structural network in an inner surface of contour similar to the outer surfaces contour spaced inwardly from the external network and including a plurality of internal struts connected at moment-stiff internal junctions, the internal network subdividing the inner surface into internal network openings, and a plurality of linear spacing maces of small cross sectional area relative to the struts interconnected between selected internal network junctions and selected external network junctions and transferring loads between the networks substantially only locally and substantially only axially, each network being supportable on the foundation separately from the other network.

2. A structure according to claim 1 in which the external and internal networks ale essentially parallel to each other.

3. A structure according to claim 1 in which the external struts and the internal struts are defined by aluminum wide flange beams.

4. A structure according to clam 1 in which the cross sectional areas and dimensions of the external and internal struts are the same.

5. A structure according to any one of the preceding claims in which the braces are defined by aluminum tubular elements.

6. A structure according to claim 1 further comprising a closure subsystem including a plurality of closure panels connected to the external struts and closing a plurality of the external network openings.

7. A structure according to claim 1 in which the external and internal networks extend to a common foundation.

8. A structure according to claim 1 in which the connections between struts at the external and the internal junctions, and the connections of the braces to the external and the internal junctions, are bolted connections.

9. A structure according to claim 1 in which the openings in the external and internal networks are rectangular and each internal junction lies on a line normal to the outer surface at the center of area of an external network opening.

10. A structure according to claim 9 in which four braces connect to each external junction and to each internal junction.

11. A structure according to claim 1 in which the openings in the internal and external networks are rectangular and each internal junction is aligned with an external network junction on a line normal to the outer surface at the center of the external network junction.

12. A structure according to claim 11 in which, in each aligned pair of external and internal junctions, only one of the junctions has braces connected to it.

13. A structure according to claim 12 in which the rectangular external openings have sides and ends parallel to a respective internal network opening and the braces lie in planes defined by corresponding external and internal struts.

14. A structure according to claim 13 in which each braced junction has four braces connected to it.

15. A structure according to claim 1 in which the external network openings are triangular.

16. A structure according to claim 15 in which the external and internal networks triangulate their respective surfaces at the same frequency.

17. A structure according to claim 16 in which each internal junction is aligned with an external junction on a line normal to the outer surface at the center of the external junction.

18. A structure according to claim 17 in which, in each aligned pair of external and internal junctions, only one of the junctions has braces connected to it.

19. A structure according to claim 18 in which each external braced junction has six braces connected to it.

20. A structure according to claim 15 in which each internal junction lies on a line normal to the outer surface which passes through the center of area of a triangular external network opening.

21. A structure according to either one of claims 17 or 20 in which there are fewer internal junctions than external junctions.

22. A structure according to claim 21 in which the internal network openings include hexagonal openings.

23. A structure according to claim 15 in which the internal network triangulates the inner surface at a triangulation frequency which is lower than the frequency at which the external network triangulates the outer surface.

24. A structure according to claim 1 in which the connections of each brace to the external and internal networks is a pinned connection.

25. A reticulated dome structural network substantially defining an outer surface of the dome, an internal structural network inwardly of the dome from the external network, and a plurality of linear spacing braces interconnected between the external and internal networks, each of the external and internal networks including a plurality of struts having flanges along strut sides which are adjacent to the other network, the struts in each network being interconnected at junctions where ends of struts are bolted to gusset plates via the strut flanges, the spacing braces being connected between selected external network junctions and selected internal network junctions via brace end flanges bolted to respective junction gusset plates, the bolts securing a brace end to a gusset plate sharing the bolts associated with two adjacent strut members at the respective junction.

26. A dome structure according to claim 25 in which the braces are tubular.

27. A dome structure according to claim 25 in which the end flanges of a brace are comprised by a plate connected to the brace end and extending laterally from opposite sides of the brace.

* * * * *

UNITED STATES PATENT AND TRADEMARK OFFICE

CERTIFICATE OF CORRECTION

PATENT NO. : 6,192,634 B1
DATED : February 27, 2001
INVENTOR(S) : Alfonso E. Lopez It is certified that error appears in the above-identified patent and that said Letters Patent is hereby corrected as shown below:

Column 19,
Line 10, replace "maces" with -- braces --.
Line 19, replace "ale" with -- are --.

Signed and Sealed this

Seventh Day of May, 2002

*Attest:*

*Attesting Officer*

JAMES E. ROGAN
*Director of the United States Patent and Trademark Office*